US010308463B2

(12) United States Patent
Tanigami

(10) Patent No.: US 10,308,463 B2
(45) Date of Patent: Jun. 4, 2019

(54) IMAGE FORMING APPARATUS AND METHOD FOR CONTROLLING IMAGE FORMING APPARATUS

(71) Applicant: Konica Minolta, Inc., Chiyoda-ku, Tokyo (JP)

(72) Inventor: Shinya Tanigami, Hachioji (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 184 days.

(21) Appl. No.: 15/665,812

(22) Filed: Aug. 1, 2017

(65) Prior Publication Data

US 2018/0050881 A1 Feb. 22, 2018

(30) Foreign Application Priority Data

Aug. 16, 2016 (JP) ..... 2016-159534

(51) Int. Cl.

| | |
|---|---|
| ***B65H 3/06*** | (2006.01) |
| ***B41J 13/10*** | (2006.01) |
| ***G03G 15/00*** | (2006.01) |
| ***B65H 23/038*** | (2006.01) |

(52) U.S. Cl.

CPC ..... *B65H 23/038* (2013.01); *G03G 15/5029* (2013.01); *G03G 15/6529* (2013.01); *G03G 15/6567* (2013.01); *B41J 13/103* (2013.01); *B65H 3/0676* (2013.01); *B65H 2403/942* (2013.01); *B65H 2553/416* (2013.01); *B65H 2601/272* (2013.01)

(58) Field of Classification Search

CPC ..... B65H 3/0676; B65H 2403/942; B65H 2553/416; B65H 2601/272; B65H 230/038; B41J 13/103; G03G 15/5029; G03G 15/6529; G03G 15/6567

See application file for complete search history.

(56) References Cited

U.S. PATENT DOCUMENTS 6,738,157 B1 * 5/2004 Hirose ..... B41J 13/0018 358/1.1
2004/0215411 A1 * 10/2004 Howe ..... B65H 9/106 702/85

(Continued)

FOREIGN PATENT DOCUMENTS

JP 2012-189672 A 10/2012

*Primary Examiner* — David H Banh

(74) *Attorney, Agent, or Firm* — Buchanan Ingersoll & Rooney PC

(57) ABSTRACT

An image forming apparatus includes: sheet feed trays on which sheets are placed; a transferrer that transfers an image formed by an image forming part onto a sheet at a transfer position; conveyance roller pairs provided along conveyance paths from the sheet feed trays to the transfer position and that conveys a fed sheet; a conveyance position detector that detects a conveyance position of a conveyed sheet in a width direction; a sheet position adjuster that performs adjustment of the conveyance position of the sheet in the width direction by using an amount of displacement; and a hardware processor that determines, on the basis of a sheet feed tray that is to be used among the sheet feed trays and a sheet length of a sheet that is to be fed from the sheet feed tray, whether or not the adjustment of the conveyance position is to be performed.

18 Claims, 16 Drawing Sheets

(56) References Cited

U.S. PATENT DOCUMENTS

| | | | | |
|---|---|---|---|---|
| 2007/0264066 | A1* | 11/2007 | Peng | G03G 15/5062 399/395 |
| 2008/0224386 | A1* | 9/2008 | Kunieda | B42C 1/12 271/226 |
| 2013/0334769 | A1* | 12/2013 | Yamazaki | B65H 7/10 271/228 |
| 2016/0103410 | A1* | 4/2016 | Yamamoto | G03G 15/6564 399/388 |
| 2016/0152431 | A1* | 6/2016 | Maeda | B65H 9/004 271/236 |
| 2016/0340143 | A1* | 11/2016 | Maenishi | B65H 31/38 |
| 2017/0291782 | A1* | 10/2017 | Sato | B65H 5/062 |
| 2018/0273323 | A1* | 9/2018 | Yamane | B65H 9/00 |

* cited by examiner

FIG. 9

| TRAY | SHEET LENGTH | GRAMMAGE (g/m²) | SKEW CORRECTION COEFFICIENT |
|---|---|---|---|
| LCT | LESS THAN 500mm | — | 0 |
| | 501mm TO 600mm | LESS THAN 100 | 0.1 |
| | | 101 OR MORE | 0.2 |
| | 601mm TO 700mm | LESS THAN 100 | 0.2 |
| | | 101 OR MORE | 0.3 |
| | 701mm TO 800mm | LESS THAN 100 | 0.3 |
| | | 101 OR MORE | 0.4 |
| MANUAL FEED TRAY | LESS THAN 700mm | — | 0 |
| | 701mm TO 900mm | LESS THAN 100 | 0.1 |
| | | 101 OR MORE | 0.2 |
| | 901mm TO 1200mm | LESS THAN 100 | 0.2 |
| | | 101 OR MORE | 0.3 |

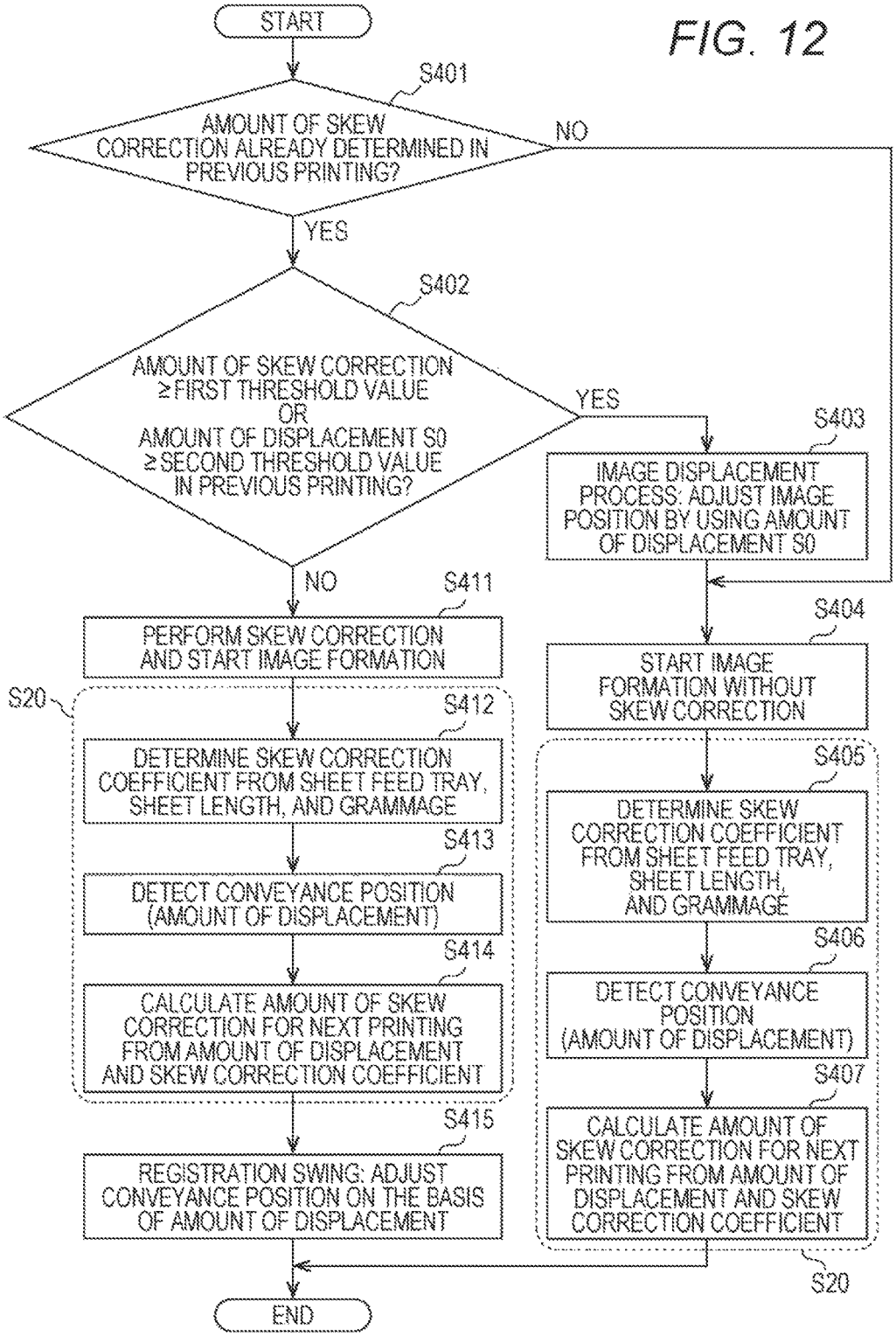
FIG. 12
START
S401
AMOUNT OF SKEW CORRECTION ALREADY DETERMINED IN PREVIOUS PRINTING?
NO
YES
S402
AMOUNT OF SKEW CORRECTION ≥ FIRST THRESHOLD VALUE OR AMOUNT OF DISPLACEMENT S0 ≥ SECOND THRESHOLD VALUE IN PREVIOUS PRINTING?
YES
S403
IMAGE DISPLACEMENT PROCESS: ADJUST IMAGE POSITION BY USING AMOUNT OF DISPLACEMENT S0
NO
S411
PERFORM SKEW CORRECTION AND START IMAGE FORMATION
S404
START IMAGE FORMATION WITHOUT SKEW CORRECTION
S20
S412
DETERMINE SKEW CORRECTION COEFFICIENT FROM SHEET FEED TRAY, SHEET LENGTH, AND GRAMMAGE
S413
DETECT CONVEYANCE POSITION (AMOUNT OF DISPLACEMENT)
S414
CALCULATE AMOUNT OF SKEW CORRECTION FOR NEXT PRINTING FROM AMOUNT OF DISPLACEMENT AND SKEW CORRECTION COEFFICIENT
S405
DETERMINE SKEW CORRECTION COEFFICIENT FROM SHEET FEED TRAY, SHEET LENGTH, AND GRAMMAGE
S406
DETECT CONVEYANCE POSITION (AMOUNT OF DISPLACEMENT)
S407
CALCULATE AMOUNT OF SKEW CORRECTION FOR NEXT PRINTING FROM AMOUNT OF DISPLACEMENT AND SKEW CORRECTION COEFFICIENT
S415
REGISTRATION SWING: ADJUST CONVEYANCE POSITION ON THE BASIS OF AMOUNT OF DISPLACEMENT
S20
END

| TRAY | SHEET LENGTH | GRAMMAGE (g/m²) | SKEW CORRECTION COEFFICIENT |
|---|---|---|---|
| DUPLEX MODE (SECOND SURFACE) | LESS THAN 500mm | – | 0.0 |
| | 501mm TO 650mm | LESS THAN 100 | 0.15 |
| | | 101 OR MORE | 0.25 |
| | 651mm TO 700mm | LESS THAN 100 | 0.25 |
| | | 101 OR MORE | 0.35 |

IMAGE FORMING APPARATUS AND METHOD FOR CONTROLLING IMAGE FORMING APPARATUS

Japanese Patent Application No. 2016-159534 filed on Aug. 16, 2016, including description, claims, drawings, and abstract the entire disclosure is incorporated herein by reference in its entirety.

BACKGROUND

Technological Field

The present invention relates to an image forming apparatus, and a method for controlling the image forming apparatus.

Description of the Related Art

In an image forming apparatus, generally, paper sheets are fed one by one from a sheet feed tray accommodating a plurality of paper sheets, conveyed to an image forming part, and image formation is performed on the paper sheets.

In the case where the paper sheets are not accommodated properly and, for example, the position of the paper sheets in a width direction perpendicular to a conveyance direction of the paper sheets is not firmly regulated by a guide regulation plate provided in the width direction, displacement in which the paper sheets are conveyed in a state of being displaced in the width direction occurs.

With regard to such displacement, for example, in an image forming apparatus disclosed in JP 2012-189672 A (particularly in paragraph 0064), the position of a conveyed paper sheet is detected by a line sensor or the like, the paper sheet is nipped on the basis of a result of the detection, and the displacement of the paper sheet is corrected by swinging a registration roller pair conveying the paper sheet in a counter direction of the displacement.

In addition, in this image forming apparatus, in the case of swinging the registration roller pair in the width direction, a conveyance roller pair that does not swing and is disposed upstream of the registration roller pair is separated while swinging the registration roller pair in order to prevent the conveyed paper sheet from being twisted or torn between the registration roller pair and the conveyance roller pair.

However, separating all conveyance roller pairs nipping the paper sheet while swinging the registration roller pair is difficult from the perspective of costs. Particularly in recent years, an image forming apparatus that supports long paper sheets whose length in a conveyance direction exceeds 1000 mm by connecting an attachable sheet feed device (large capacity tray: LCT) to a body of the image forming apparatus has been put on the market. In such a case, it is not practical to configure all conveyance roller pairs to be separable.

In the image forming apparatus disclosed in JP 2012-189672 A (particularly in paragraph 0064), in the case of conveying a long paper sheet, not all of the detected displacement is corrected by the swing of the registration roller pair, and part of the correction is performed by image processing in which pixel positions are shifted.

However, in the technique disclosed in JP 2012-189672 A (particularly in paragraph 0064), there is a problem that the paper sheet is slightly skewed (inclined) because the registration roller pair on the downstream side is caused to swing while nipping the paper sheet by the conveyance roller pair on the upstream side although the amount of swing is reduced by correcting part of the displacement via image processing in the case of a long paper sheet.

SUMMARY

The present invention has been made in consideration of the situation described above. That is, an object of the present invention is to provide an image forming apparatus.

The abovementioned object of the present invention is achieved by the following means.

To achieve the abovementioned object according to an aspect of the present invention, an image forming apparatus reflecting one aspect of the present invention comprises:

a plurality of sheet feed trays on which a plurality of sheets are placed;

a transferrer that transfers an image formed by an image forming part onto a sheet at a transfer position;

a plurality of conveyance roller pairs provided along conveyance paths from the plurality of sheet feed trays to the transfer position and that conveys a fed sheet;

a conveyance position detector that detects, at a position upstream of the transfer position, a conveyance position of a conveyed sheet in a width direction perpendicular to a conveyance direction;

a sheet position adjuster that performs, at an adjustment position upstream of the transfer position, adjustment of the conveyance position of the sheet in the width direction by using an amount of displacement calculated from the detected conveyance position and a hardware processor that determines, on the basis of a sheet feed tray that is to be used among the plurality of sheet feed trays and a sheet length of a sheet that is to be fed from the sheet feed tray, whether or not the adjustment of the conveyance position is to be performed.

BRIEF DESCRIPTION OF THE DRAWING

The advantages and features provided by one or more embodiments of the invention will become more fully understood from the detailed description given hereinbelow and the appended drawings which are given by way of illustration only, and thus are not intended as a definition of the limits of the present invention:

FIG. 9 is an example of a correction table used for determination of a skew correction coefficient;

FIG. 12 is a flowchart illustrating a control method according to a fourth embodiment;

DETAILED DESCRIPTION OF EMBODIMENTS

Figure 1:
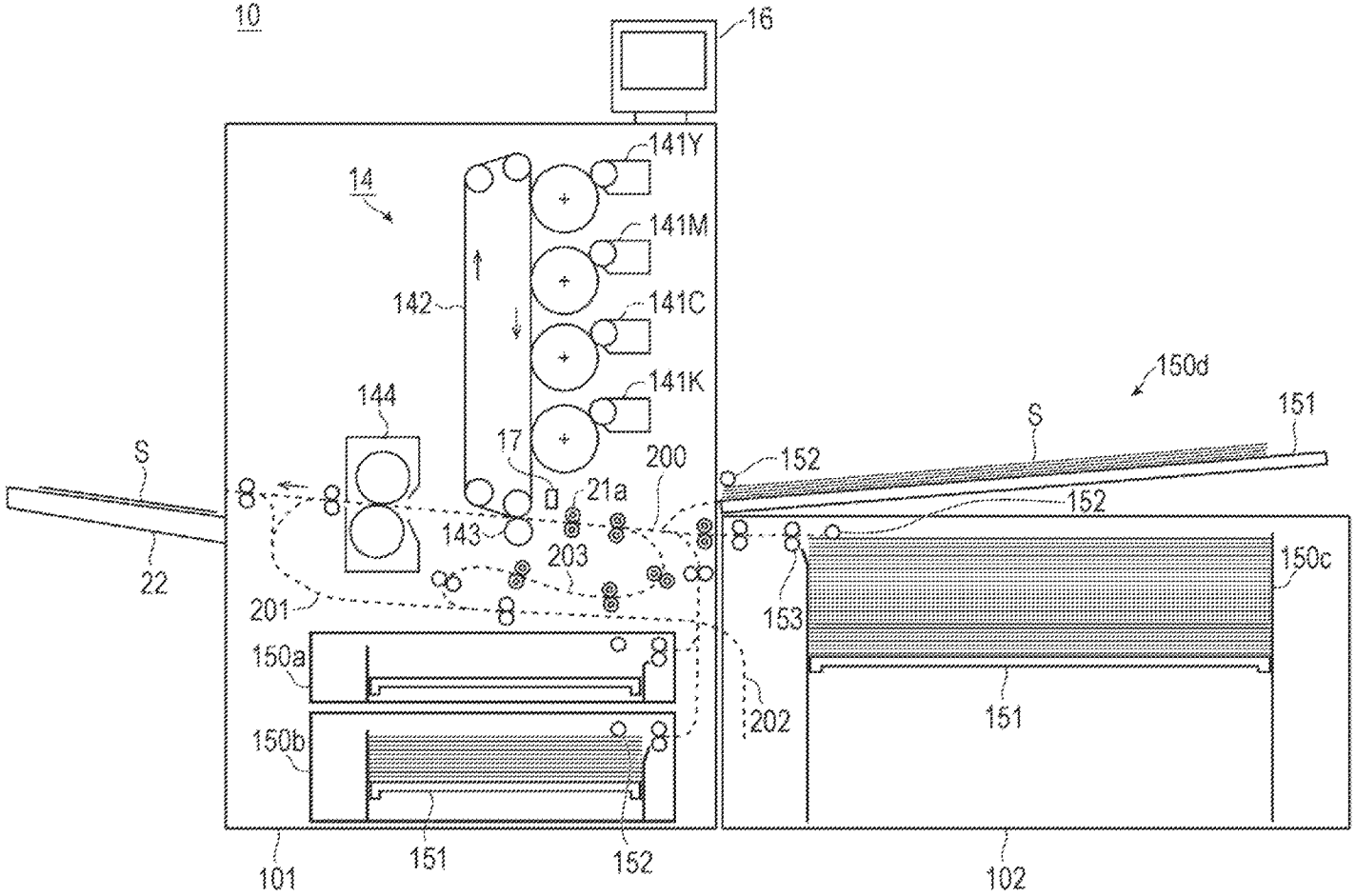
FIG. 1 is a diagram illustrating a schematic configuration of an image forming apparatus according to an embodiment of the present invention.

Hereinafter, one or more embodiments of the present invention will be described with reference to the drawings. However, the scope of the invention is not limited to the disclosed embodiments. In description of the drawings, the sane reference signs will be assigned to the same elements, and redundant description will be omitted. In addition, the dimensional ratios in the drawings are exaggerated for the sake of convenience for description, and may be different from the actual ratio. In the description below, a sheet conveyance direction will be simply referred to as a "conveyance direction", and a direction perpendicular to the conveyance direction will be referred to as a "width direction" when no particular description is given. In addition, the conveyance direction and the width direction will be also referred to as a "sub-scanning direction" and a "main scanning direction", respectively.

Figure 2:
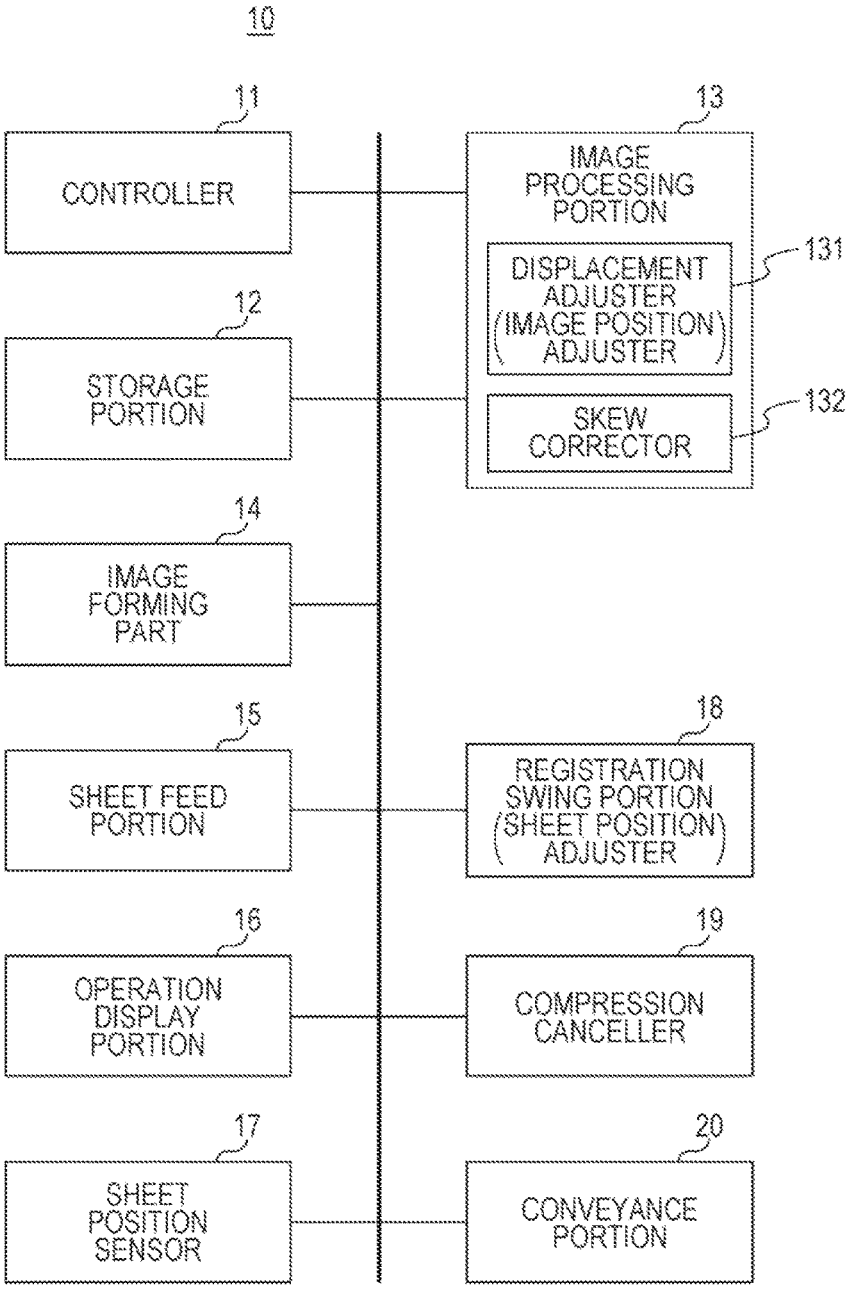
FIG. 2 is a block diagram illustrating a hardware configuration of the image forming apparatus.

FIG. 1 is a diagram illustrating a schematic configuration of an image forming apparatus according to an embodiment of the present invention. FIG. 2 is a block diagram illustrating a hardware configuration of the image forming apparatus.

(Overall Configuration)

As illustrated in FIGS. 1 and 2, an image forming apparatus 10 includes an image forming apparatus body 101 and a large capacity sheet feed apparatus 102.

The image forming apparatus 10 includes, as hardware components, a controller 11, a storage portion 12, an image processing portion 13, an image forming part 14, a sheet feed portion 15, an operation display portion 16, a sheet position sensor 17, a registration swing portion 18, a compression canceller 19, and a conveyance portion 20, and these components are mutually connected via a signal line such as a bus for communicating signals.

(Controller 11)

The controller 11 is a central processing unit (CPU) that controls each component of the image forming apparatus 10 and performs various computations.

(Storage Portion 12)

The storage portion 12 includes a read only memory (ROM) that stores various programs and various data in advance, a random access memory (RAM) that serves as a work area and temporarily stores programs and data, a hard disk that stores various programs and various data, and so forth. In addition, the storage portion 12 stores information about a skew correction coefficient that will be described later and the size (sheet width and sheet length), grammage (basis weight), and type (coated paper, normal paper, or the like) of a paper sheet accommodated in each sheet feed tray. Further, the storage portion 12 also stores settings related to whether or not a "measurement mode" and "image displacement processing" that will be described later are to be executed.

(Image Processing Portion 13)

The image processing portion 13 includes a page memory, a buffer, and an image control circuit. The page memory stores image data obtained by rasterizing print data included in a print job. The buffer stores image data for respective basic colors (Y, M, C, and K) of the image forming part 14. The image control circuit processes these data. The image data stored in the buffer is transmitted to a drawing portion of the image forming part 14 for every one line image in the main scanning direction at predetermined timings in which the position thereof in the main scanning direction and sub-scanning direction is adjusted. In addition, the image processing portion 13 includes functions of a displacement adjuster 131 and a skew corrector 132.

(Displacement Adjuster 131 (Image Position Adjuster))

The displacement adjuster 131 adjust an image forming position before transfer by, for example, processing image data such that pixels are drawn at positions shifted in the main scanning direction by a number of pixels corresponding to the amount of displacement and controlling the timing of transmitting image data of one line to the drawing portion.

(Skew Corrector 132)

The skew corrector 132 performs skew correction by adjusting the image forming position of an image to be formed on a transfer belt 142 before transfer on the basis of an amount of skew correction. Specifically, the skew corrector 132 corrects the two-dimensional position of image data to rotate the arrangement of pixels by a degree corresponding to the amount of skew correction, and stores the corrected image data in the buffer. The buffer transmits line images each corresponding to one line to the drawing portion.

In another example of skew correction processing, the correction of two-dimensional position may be omitted. That is, the image data may be processed such that the image data is drawn at positions shifted in the main scanning direction by a number of pixels corresponding to the amount of skew correction in accordance with the position of the image data in the sub-scanning direction. Specifically, for example, a case where the paper sheet is skewed by 2 mm at the leading end and by 0 mm at the trailing end is assumed. In this case, the image data is processed such that pixels are drawn at positions shifted in the main scanning direction by 2 mm, 1 mm, and 0 mm at a leading end position, a center position, and a trailing end position in the paper sheet, respectively, or the timing of transmitting image data of one line to the drawing portion is controlled in accordance with the position in the sub-scanning direction.

(Image Forming Part 14)

The image forming part 14 forms an image via, for example, an electrophotographic system, and includes a drawing portion (not illustrated) corresponding to each of basic colors, developing units 141Y, 141M, 141C, and 141K (these will be collectively referred to as "developing units 141"), an intermediate transfer belt 142, a transferrer 143, a fixing portion 144, and so forth.

Each of the developing units 141 have the same configuration except that the color of toner accommodated therein is different. Latent images are formed on photosensitive drums of the developing units 141 by the drawing portion exposing the photosensitive drums in accordance with image data, and toner images of respective colors are formed by developing devices developing these latent images. These toner images are sequentially superposed on the intermediate transfer belt 142, and a full-color toner image is thus formed. The full-color toner image is transferred onto a paper sheet at a "transfer position" in the transferrer 143, and a toner image is thus formed on the paper sheet. This toner image is subjected to heat at the fixing portion 144, and is thus fixed to the surface of the paper sheet. In the case where the temperature is low, the heating at the fixing portion 144 may be insufficient. Therefore, the conveyance speed of the paper sheet S is switched to a low speed in this case. Specifically, in the case where a value detected by a temperature sensor in the image forming apparatus 10 is equal to or lower than a predetermined temperature, the conveyance speed (processing speed) of the paper sheet S is switched in accordance with the temperature.

(Sheet Feed Portion 15)

The sheet feed portion 15 includes a plurality of sheet feed trays 150*a*, 150*b*, 150*c*, and 150*d*. The sheet feed trays 150*a*, 150*b*, 150*c*, and 150*d* each include a placement stage 151 on which a plurality of paper sheets are placed, and sending-out roller 152 that sends out the uppermost paper sheet of the plurality of paper sheets placed on the placement stage 151. The placement stage 151 of each of the sheet feed trays 150*a*. 150*b*, and 150*c* ascends and descends in accordance with the amount (height) of the paper sheets such that the upper most paper sheet is at a predetermined height. In the description below, the sheet feed tray 150*c* and the sheet feed tray 150*d* will be respectively referred to as an LCT tray 150*c* and a manual feed tray 150*d*. In addition, these sheet feed trays will be collectively referred to as "sheet feed trays 150".

(Operation Display Portion 16)

The operation display portion 16 includes a touch panel, a numeric keypad, a start button, a stop button, and so forth, and is used for displaying various information such as a warning screen and inputting various settings and instructions.

(Sheet Position Sensor 17 (Conveyance Position Detector))

The sheet position sensor 17 detects the position (hereinafter also referred to as a "conveyance position") of an end portion of a conveyed paper sheet S in the width direction. The controller 11 calculates, from the detected position of the end portion and the width of the paper sheet S that has been obtained in advance, the amount of displacement between a center position of the paper sheet S and a standard conveyance position (hereinafter referred to as an "amount of displacement"). The sheet position sensor 17 is a so-called line sensor that is an image sensor in which photoelectric conversion elements constituted by contact image sensors (CISs) are arranged in one or a plurality of lines and reads one-dimensional images. The sheet position sensor 17 includes optical elements such as light emitting elements and a lens array arranged along the lines of the photoelectric conversion elements. The sheet position sensor 17 is disposed at a position upstream of the transfer position in the conveyance direction so as to oppose a surface of the paper sheet S passing through a conveyance path 200, and, in the sheet position sensor 17, the line of photoelectric conversion elements is disposed along a direction intersecting with the conveyance direction of the paper sheet S, preferably along the width direction.

Although the sheet position sensor 17 and a registration roller pair 21*a* are arranged such that the registration roller pair 21*a* is positioned upstream of a detection region of the sheet position sensor 17 in the conveyance direction in, for example, FIG. 1, the arrangement is not limited to this. The sheet position sensor 17 and the registration roller pair 21*a* may be arranged in any positional relationship as long as the sheet position sensor 17 and the registration roller pair 21*a* are disposed upstream of the transfer position.

(Conveyance Portion 20)

Figure 3:
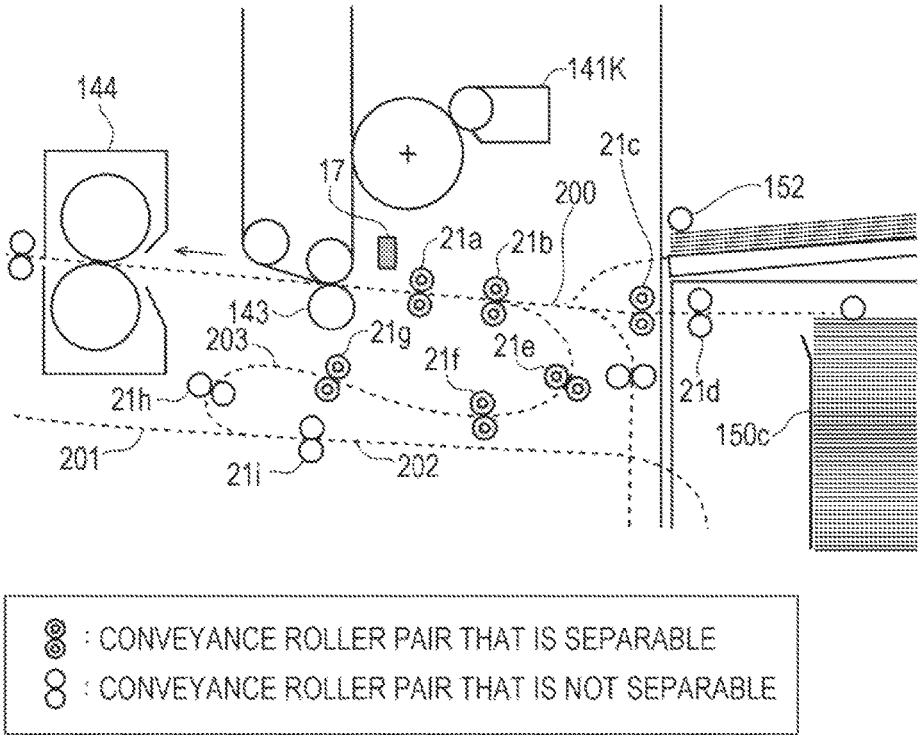
FIG. 3 is a partially enlarged view of FIG. 1.

The conveyance portion 20 will be described before describing the registration swing portion 18 and the compression canceller 19. FIG. 3 is a partially enlarged view of FIG. 1. The conveyance portion 20 conveys a paper sheet S fed from the sheet feed portion 15 in the image forming apparatus 10 as illustrated in FIG. 3. The conveyance portion 20 includes conveyance paths 200 to 203, a plurality of conveyance roller pairs 21*a* to 21*i* provided along the conveyance paths 200 to 203, and driving motors (not illustrated) that drive the conveyance roller pairs 21*a* to 21*i*. The conveyance roller pairs 21*a* to 21*i* will be collectively referred to as "conveyance roller pairs 21". The paper sheet S fed from a sheet feed tray 150 is conveyed along the conveyance path 200 by the conveyance roller pairs 21. In the conveyance roller pairs 21, the conveyance roller pairs 21*a* and 21*b* respectively function as a registration roller pair and a loop roller pair. In the description below, the conveyance roller pairs 21*a* and 21*b* will be also respectively referred to as the registration roller pair 21*a* and a loop roller pair 21*b*. In the case of forming an image on the paper sheet S, the paper sheet S conveyed to the registration roller pair 21*a* is caused to abut a nip portion of the registration roller pair 21*a* that is temporarily stopped. By keep on rotating the loop roller pair 21*b* positioned upstream of the registration roller pair 21*a* in this state, a loop of the paper sheet S is formed between the registration roller pair 21*a* and the loop roller pair 21*b*. By forming this loop, the leading end of the paper sheet S becomes parallel to the axial direction of a registration roller pair 21*a* (skew correction). Then, the conveyance of the paper sheet S is started again by starting the rotation of the registration roller pair 21*a*, the loop roller pair 21*b*, and so forth in synchronization with the timing of image formation, the paper sheet S is conveyed to the image forming part 14, and an image is formed on the paper sheet S. Then, the paper sheet S is discharged onto a sheet discharge tray 22.

(Sheet Inverter)

In addition, in the case of forming images on both surfaces of the paper sheet S, the paper sheet S on one surface (front surface) of which an image has been formed by the image forming part 14 is conveyed to the conveyance paths 201 to 203 for duplex printing. The conveyance path 202 and the conveyance roller pair 21*i* function as a "sheet inverter". The paper sheet S conveyed to the conveyance path 202 for inversion is conveyed again to the image forming part 14 via the conveyance paths 203 and 200 downstream of the conveyance path 202 after the paper sheet S is switched back and the front and back surfaces of the paper sheet S are inverted as a result of the convey ace roller pair 21*i* rotating in a normal rotation direction and a reverse rotation direction, and an image is formed on the other surface (back surface) of the paper sheet S.

(Registration Swing Portion 18 (Sheet Position Adjuster))

The registration swing portion 18 swings the registration roller pair 21*a* in the axial direction (width direction). The registration swing portion 18 includes, for example, a driving motor and a cant that is rotated by the driving motor and abuts the registration roller pair 21*a* in the axial direction. In the description below, a nip position of the registration roller pair 21*a* in the conveyance direction will be also referred to as an "adjustment position".

The amount of swing (corresponding to the distance of movement, also referred to as an "amount of adjustment") is controlled by the controller 11, and the amount of displacement is set as the amount of swing. The conveyance position of the paper sheet S in the width direction is adjusted by swinging the registration roller pair 21*a* while conveying the paper sheet S.

Registration swing is performed at such a timing that the registration swing starts after the leading end side of the paper sheet S has passed through the detection region of the sheet position sensor 17 and the amount of displacement has been calculated, and that the registration roller pair 21*a* preferably reaches a swing target position corresponding to the amount of displacement before the leading end of the paper sheet S reaches the transfer position. The registration roller pair 21*a* returns to an original home position and takes an original compression state at least before the leading end of a preceding sheet reaches the registration roller pair 21*a*. The registration roller pair 21*a* preferably starts returning to the home position immediately after the leading end of the paper sheet S reaches the transferrer 143 or the fixing portion 144 and no longer needs to be conveyed by the registration roller pair 21*a*. The compression of the registration roller pair 21*a* is canceled by the compression canceller 19 that will be described below while the registration roller pair 21*a* is returning to the home position, and thus the conveyance of the paper sheet S is not influenced.

(Compression Canceller 19)

The compression canceller 19 cancels the compression of at least one of the plurality of conveyance roller pairs 21 provided along the conveyance paths 200 to 203, and thus changes the state of the at least one of the plurality of conveyance roller pairs 21 to a separate state. In the present embodiment, the compression canceller 19 is connected to the conveyance roller pairs 21*a*. 21*b*, 21*c*, 21*e*, 21*f*, and 21*g*. The conveyance roller pairs 21 that can be separated by the compression canceller 19 are indicated by double circles in FIGS. 1 and 3. This also applies to FIG. 10 that will be described later. A shaft of one roller of a conveyance roller pair 21 connected to the compression canceller 19 is fixed, and a shaft of the other of the conveyance roller pair 21 is movable. The rollers of the conveyance roller pair 21 are each urged by a predetermined pressure by an elastic member such as a spring, are normally in a compressed state, and convey the paper sheet S while nipping the paper sheet S at a nip portion of the rollers. By causing the compression canceller 19 to operate, a rotation shaft of the other roller moves away from the one roller, and the rollers take a separate state in which the rollers are not in contact with each other.

When the registration roller pair 21*a* is swung in the axial direction by the registration swing portion 18 while nipping and conveying the paper sheet S (hereinafter simply referred to as "registration swing"), a conveyance roller pair 21 positioned upstream of the registration roller pair 21*a* and nipping the paper sheet S is switched to the separate state by the compression canceller 19. For example, in the case of feeding the paper sheet S from the LCT tray 150*c* and performing the registration swing, the conveyance roller pairs 21*b* and 21*c* upstream of the registration roller pair 21*a* are switched to the separate state.

(Sheet Feed Trays and Sheet Length)

Figure 4A:
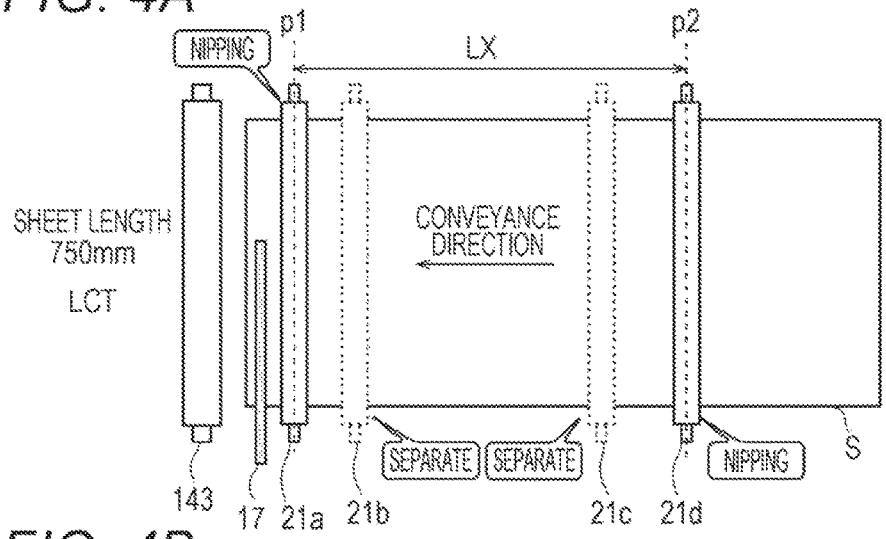
FIGS. 4A to 4C are each a schematic top view of conveyance roller pairs and a paper sheet illustrating a positional relationship therebetween.
Figure 4B:
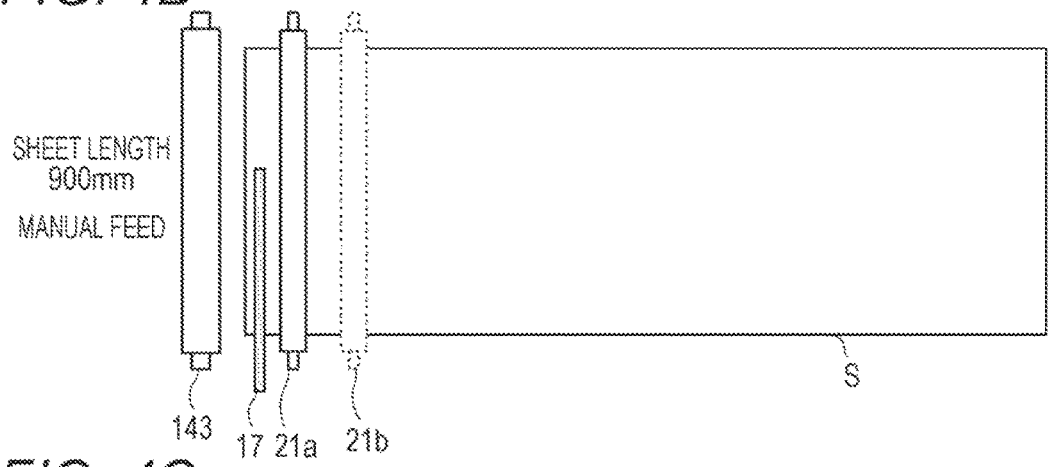
Figure 4C:
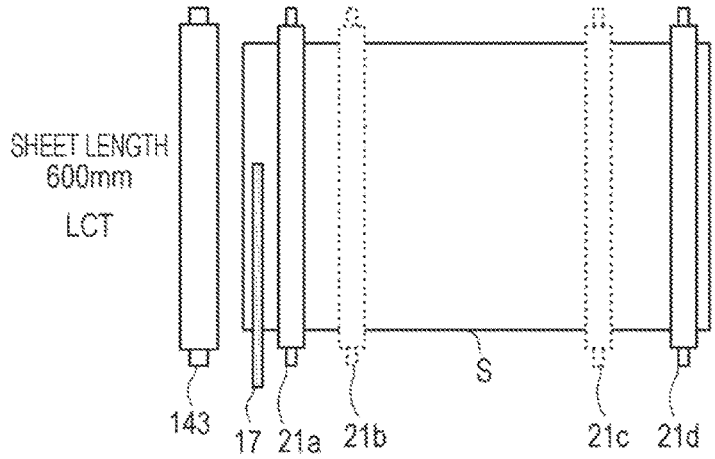

Next, relationships between sheet feed trays, sheet length, and skew will be described with reference to FIGS. 4A to 4C, 5A, and 5B. Here, "sheet length" corresponds to the length of the paper sheet S in the conveyance direction. FIGS. 4A to 4C, 5A, and 5B are each a schematic top view of the conveyance roller pairs 21 in the conveyance paths and a paper sheet S illustrating a positional relationship thereof. FIG. 4A illustrates a state in which a paper sheet S of a sheet length of 750 mm is fed from the LCT tray 150*c*, FIG. 4B illustrates a state in which a paper sheet S of a sheet length of 900 mm is fed from the manual feed tray 150*d*, and FIG. 4C illustrates a state in which a paper sheet S of a sheet length of 600 mm is fed from the LCT tray 150*c*. In addition, in all of FIGS. 4A to 4C, the leading end of the paper sheet S that is fed reaches the detection region of the sheet position sensor 17, and thus the conveyance position is detected. At this timing, the registration swing can be performed in accordance with the amount of displacement calculated from the conveyance position.

Referring to FIG. 4A, a distance Lx between a nip position p (adjustment position) of the registration roller pair 21*a* and a nip position p2 of the conveyance roller pair 21*d* is, for example, 500 mm. The sheet length of 750 mm is longer than the distance Lx. Although the conveyance roller pairs 21*b* and 21*c* are switched to the separate state when starting the registration swing, the conveyance roller pair 21*d* cannot be switched to the separated state due to the configuration thereof, and thus remains in the compressed state and nips the paper sheet S. In FIGS. 4A to 4C, conveyance roller pairs 21 nipping the paper sheet S are indicated by solid lines, and conveyance roller pairs 21 whose compression has been canceled and which do not nip the paper sheet S are indicated by broken lines.

Under this condition, in the case where the registration swing is started in the state illustrated in FIG. 4A, the trailing end of the paper sheet S is nipped by the conveyance roller pair 21*d* in a partial period before the trailing end of the paper sheet S passes through the conveyance roller pair 21*d*. In this period, while the leading end side of the paper sheet S is moved in the axial direction by the registration swing, the trailing end side is pressed by the conveyance roller pair 21*d* to suppress the movement.

Figure 5A:
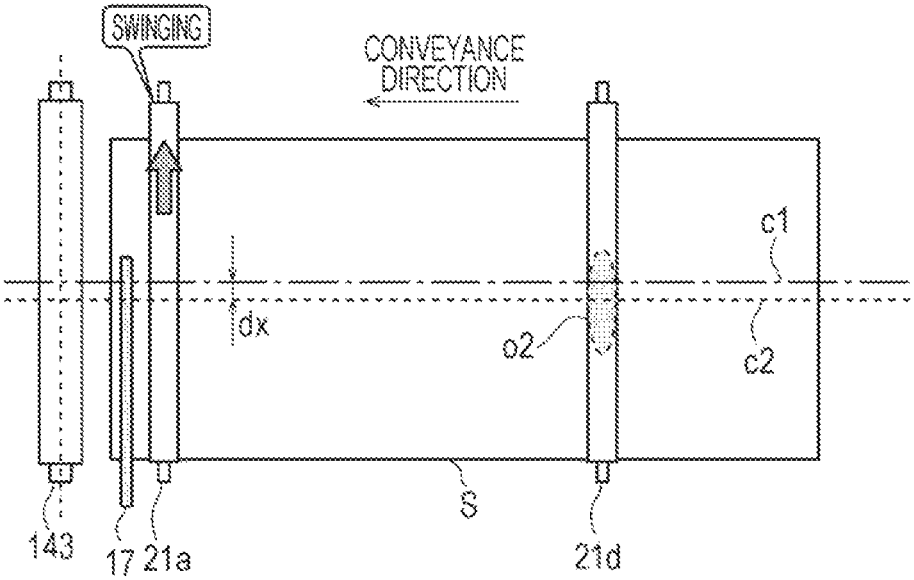
FIGS. 5A and 5B are each a schematic top view of conveyance roller pairs and a paper sheet illustrating a positional relationship therebetween.
Figure 5B:
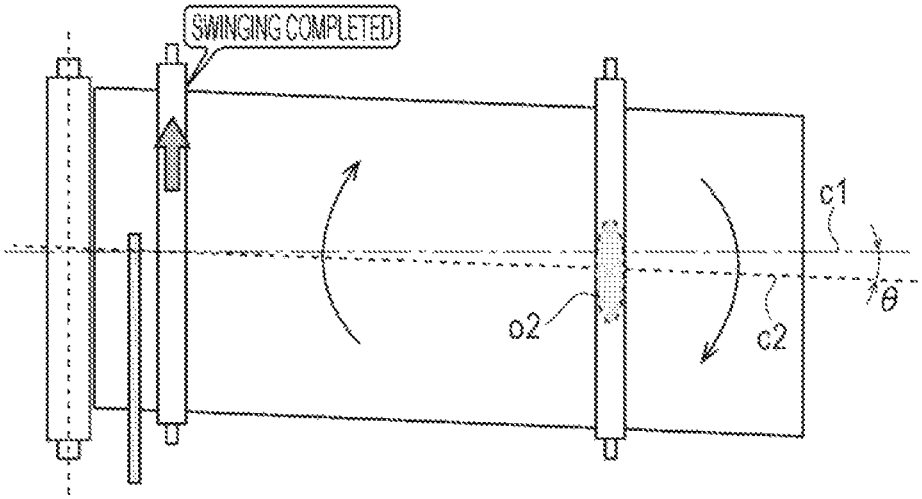

FIGS. 5A and 5B are each a schematic diagram for description of a phenomenon of the paper sheet S being skewed by the registration swing. FIG. 5A illustrates a conveyance state of the paper sheet S before the registration swing. In FIG. 5A, a center position c2 of the paper sheet S in the width direction is displaced to the left (downward in FIG. 5A) from a conveyance standard position c1 by an amount of displacement dx when viewed in the conveyance direction. By performing the registration swing in this state, the paper sheet S is swung in a direction that cancels the amount of displacement dx, that is, to the right (upward in FIG. 5A), and thus the conveyance position is adjusted.

As illustrated in FIG. 5B, in the case where the conveyance position of the paper sheet S is adjusted, since the trailing end side of the paper sheet S is pressed by the conveyance roller pair 21*d*, the paper sheet S overall rotates clockwise around a point o2 by an angle θ (amount of skew).

As described above, in the case where the paper sheet S of the sheet length of 750 mm is fed from the LCT tray 150*c* as illustrated in FIG. 4A, the paper sheet S is skewed by an influence of the registration swing. Meanwhile, in the case where the paper sheet S is fed from the manual feed tray 150*d* as illustrated in FIG. 4B, although the sheet length is as long as 900 mm, which is sufficiently long, all the conveyance roller pairs 21 disposed on the upstream side in the conveyance path are all switched to the separate state, and no conveyance roller pair 21 nips the paper sheet S at the time of the registration swing. Therefore, the phenomenon of the paper sheet S being skewed as illustrated in FIGS. 5A and 5B does not occur.

In addition, in the case of the condition illustrated in FIG. 4C, that is, in the case where the sheet length is 600 mm, which is not much larger than the distance Lx, the phenomenon of the paper sheet S being skewed hardly occurs even when the paper sheet S is fed from the LCT tray 150*c*.

In this way, the amount of skew caused by the registration swing depends on the sheet feed tray. More specifically, the amount of skew depends on the distance from a conveyance roller pair that is not separated at the time of the registration swing to the adjustment position corresponding to the sheet feed tray that is used. In addition, the amount of skew depends on the sheet length also in the case where the sheet length is larger than the distance Lx to the conveyance roller pair that is not separated. In addition, as another factor the amount of skew is larger for a paper sheet S of a larger grammage (basis weight) even in the case were the sheet length (the size of the paper sheet S) is the same. In addition, regarding the type of the paper sheet S, the amount of skew is larger for a coated paper sheet than for a normal paper sheet even in the case where the sheet length is the same. It is considered that these phenomena are influenced by the rigidity of the fed paper sheet S. The higher the rigidity of the paper sheet S is in accordance with the grammage or the type of the paper sheet S, the paper sheet S is less likely to be warped, and the influence of the registration swing at the adjustment position at the leading end of the paper sheet S is more likely to be transmitted to the trailing end of the paper sheet S. In addition, the amount of skew becomes smaller as the conveyance speed of the paper sheet S becomes slower.

(Operation of Image Forming Apparatus 10)

Next, a characteristic method for controlling the image forming apparatus 10 will be described.

First Embodiment

Figure 6:
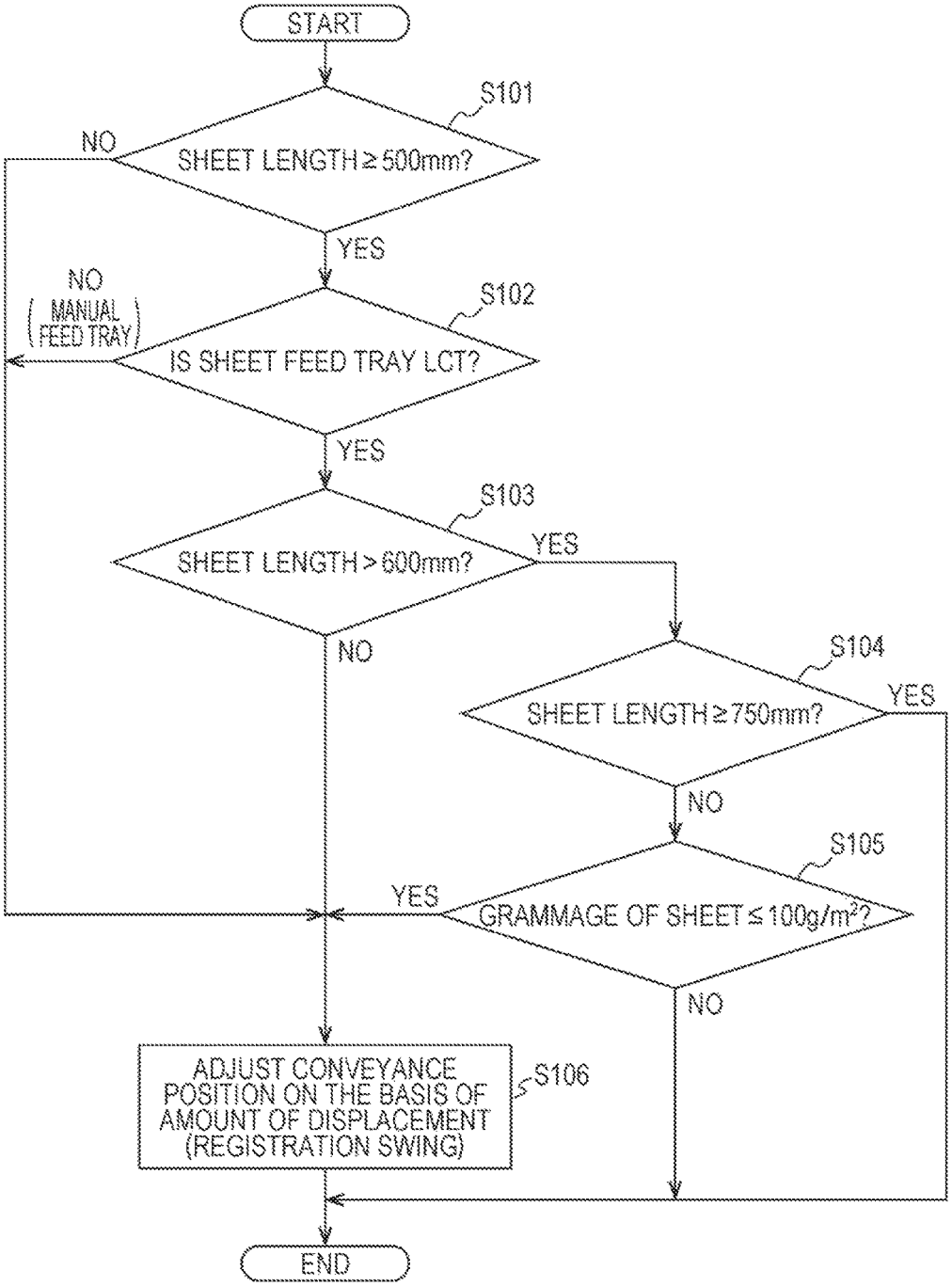
FIG. 6 is a flowchart illustrating a control method according to a first embodiment.

FIG. 6 is a flowchart illustrating a control method according to a first embodiment, and the flow is executed by the controller 11. An instruction of starting a print job is received from a user through a personal computer (PC) terminal or the operation display portion 16, and thus printing is started. The print job includes a job ticket in which print settings such as the size of the paper sheet S and the sheet feed tray that are to be used are described, and image data serving as a basis of an image to be printed.

The controller 11 determines whether or not the sheet length of the paper sheet S that is to be used first is 500 mm or larger on the basis of the job ticket (S101).

In the case where the sheet length is smaller than 500 mm (S101: NO), the registration swing is performed, on the basis of the amount of displacement calculated from the conveyance position detected by the sheet position sensor 17, to adjust the conveyance position of the paper sheet S (S106). Then, image formation is performed by the image forming part 14. In the case where the sheet length is smaller than 500 mm, no conveyance roller pair 21 nips the trailing end side of the paper sheet S at the time of the registration swing regardless of from which of the sheet feed trays 150 including the sheet feed trays 150*a* and 150*b* in the image forming apparatus body 101 the paper sheet S is fed. The registration swing is performed in this case because the phenomenon of the paper sheet S being skewed as illustrated in FIGS. 5A and 5B does not occur for the reason described above.

In contrast, in the case where the sheet length is 500 mm or larger (S101: YES), whether or not the sheet feed tray 150 to be used in the print job is the LCT tray 150*c* is determined (S102). In the case where the sheet feed tray 150 to be used is not the LCT tray 150*c* (S102: NO), that is, in the case where the sheet feed tray 150 to be used is the manual feed tray 150*d*, the process proceeds to step S106, and the registration swing is performed. The registration swing is performed in this case because, similarly in the case of the manual feed tray 150*d*, no conveyance roller pair 21 nips the trailing end side of the paper sheet S at the time of the registration swing as illustrated in FIG. 4B, and the phenomenon of the paper sheet S being skewed as illustrated in FIGS. 5A and 5B does not occur. To be noted, a paper sheet S of a sheet length of 500 mm or larger can be fed only from the LCT tray 150*c* and the manual feed tray 150*d*, and the sheet feed trays 150*a* and 150*b* cannot accommodate paper sheets S as long as or longer than 500 mm.

In the case where the sheet feed tray 150 to be used is the LCT tray 150*c* (S102: YES), whether or not the sheet length exceeds 600 mm is determined (S103). In the case where the sheet length does not exceed 600 mm (S103: NO), the process proceeds to step S106, and the registration swing is performed. The registration swing is performed in this case because, as illustrated in FIG. 4C, although the LCT tray 150*c* is used and there is a conveyance roller pair 21 that nips the trailing end side of the paper sheet S at the time of the registration swing, the period of nipping the paper sheet S is short, and the phenomenon of the paper sheet S being skewed as illustrated in FIGS. 5A and 5B hardly occurs.

In the case where the sheet length exceeds 600 mm (S103: YES), whether or not the sheet length is 750 mm or larger is determined (S104). In the case where the sheet length is 750 man or larger (S104: YES), image formation is performed by the image forming part 14 without performing the registration swing, and the process is finished.

In the case where the sheet length is smaller than 750 mm (S104: NO), whether or not the grammage of the paper sheet S is 100 g/m$^2$ or smaller is determined (S105). In the case where the grammage is 100 g/m$^2$ or smaller (S105: YES), the process proceeds to step S106, and the registration swing is performed. In the case where the grammage of the paper sheet S is small, the rigidity of the paper sheet S is relatively small, and the influence of the registration swing at the adjustment position of the leading end is less likely to be transmitted to the trailing end of the paper sheet S. Therefore, even in the case where there is a conveyance roller pair 21 that nips the trailing end side of the paper sheet S at the time of the registration swing, the phenomenon of the paper sheet S being skewed as illustrated in FIGS. 5A and 5B hardly occurs.

As described above, in the present embodiment, whether or not to perform the registration swing is determined on the basis of the sheet feed tray to be used and the sheet length of the paper sheet S fed from the sheet feed tray, and the registration swing is performed in the case where there is no risk of the paper sheet S being skewed or where the amount of skew is expected to be small. This enables preventing the increase of the skew of the paper sheet S.

Modification of First Embodiment

Figure 7:
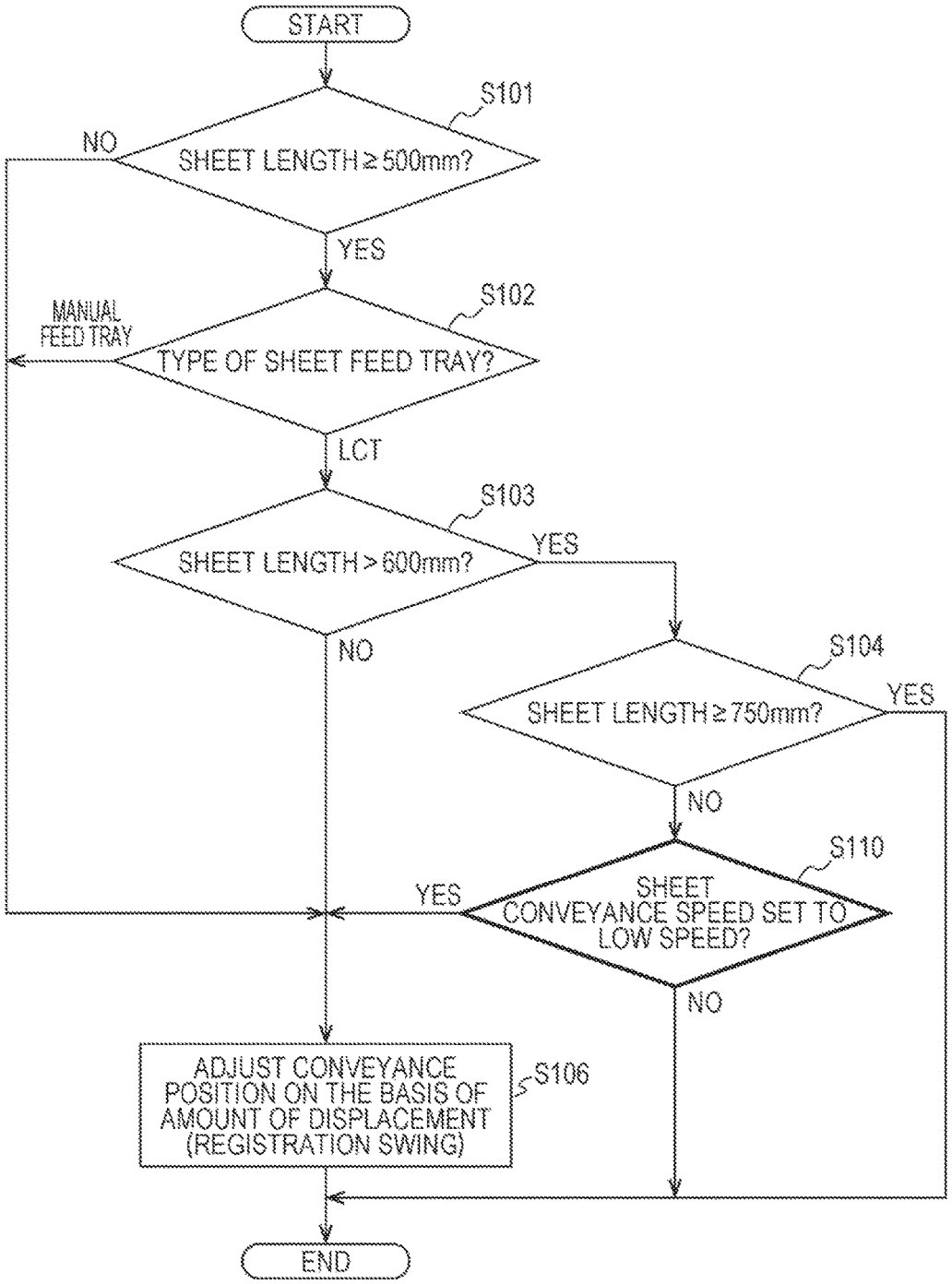
FIG. 7 is a flowchart illustrating a control method according to a modification.

FIG. 7 is a flowchart illustrating a control method according to a modification, and the flow is executed by the controller 11. In the modification, the process of step S110 is different from the first embodiment. The processes of the other steps are the same as the first embodiment, and thus the description thereof will be omitted.

In step S110, the controller 11 determines whether or not the conveyance speed of the paper sheet S is set to a low speed. For example, in the case where the temperature sensor in the image forming apparatus 10 detects a low temperature equal to or lower than a predetermined value and the conveyance speed is set to a low speed that is a half of a normal speed, the process proceeds to step S106 even if the sheet length of the paper sheet S fed from the sheet feed tray 150*c* is 600 to 750 mm, and the registration swing is performed. This is because the lower the conveyance speed of the paper sheet S is, the smaller the influence of the registration swing becomes and thus the smaller the amount of skew becomes.

As described above, the same effect as the first embodiment can be achieved also in the modification of the first embodiment.

Second Embodiment

In the first embodiment, the registration swing is not performed in the case where the amount of skew is influenced by the registration skew or where it is determined that the influence of the registration swing is not small. In a second embodiment that will be described below, the amount of skew that will be caused by the registration swing is estimated in advance on the basis of the amount of displacement, and the skew is corrected via image processing in accordance with the estimated amount of skew.

Figure 8:
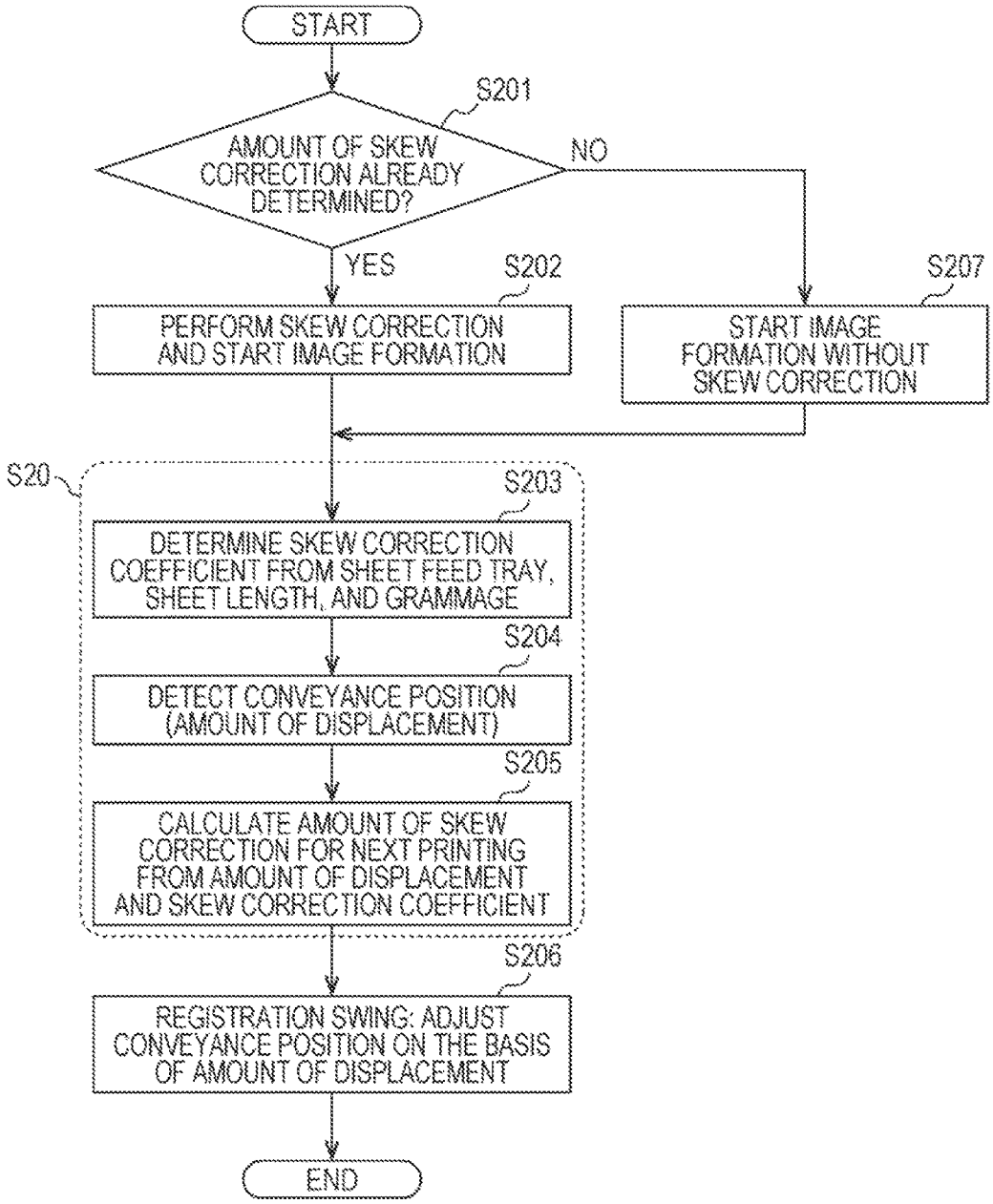
FIG. 8 is a flowchart illustrating a control method according to a second embodiment.

FIG. 8 is a flowchart illustrating a control method according to a second embodiment, and the flow is executed by the controller 11.

First, the controller 11 determines whether or not the amount of skew correction has been determined (S201). In the case where first image of the print job is to be printed, the amount of skew correction is not determined (S201: NO), and thus image formation by the image forming part 14 is started by using image data with which skew correction is not to be performed (S207).

The subsequent processes of steps S203 to S205 are processes of calculating and storing the amount of skew correction. These processes will be indicated by a broken-line rectangle in FIG. 8 and subsequent flowcharts, and the processes will be also collectively referred to as a "skew correction amount determination process S20".

In the skew correction amount determination process S20, first, information of the sheet feed tray, the sheet length, and the grammage of the paper sheet S to be used for the print job is obtained, and a skew correction coefficient is determined on the basis of this information.

FIG. 9 is an example of a correction table used for determination of the skew correction coefficient. The amount of skew depends on the amount of displacement (amount of swing), and the degree of dependence varies in accordance with the sheet feed tray, the sheet length, and the grammage of the paper sheet S to be used as described above. As described above, the sheet feed tray is related to the position (distance from the adjustment position) and number of at least one conveyance roller pair that nips the paper sheet S (is not separated) at the time of the registration swing. In the present embodiment, in the case where the paper sheet S is conveyed in the same condition in terms of the amount of swing, the sheet feed tray, the sheet length, and the grammage, the reproducibility of the amount of skew is high. Therefore, a correction coefficient corresponding to the amount of skew is obtained in advance, and the obtained correction coefficient is stored in the storage portion 12.

FIG. 9 is an example of a correction table indicating a correspondence between each parameter of the sheet feed tray, the sheet length, and the grammage and the skew correction coefficient. To be noted, the sheet feed trays 150*a* and 150*b* of the image forming apparatus body 101 cannot accommodate or feed a paper sheet S of the sheet length of 500 mm or larger, and thus all of the correction coefficients corresponding to the sheet feed trays 150*a* and 150*b* are 0. Therefore, the correction coefficients corresponding to the sheet feed trays 150*a* and 150*b* are omitted from the correction table of FIG. 9. For example, in the case where the parameters are the LCT tray 150*c*, the sheet length of 600 mm, and the grammage of 120 g/m$^2$, a skew correction coefficient $\alpha$ is determined as "0.2".

Subsequently, the conveyance position of the paper sheet S conveyed to the transfer position of the image forming part 14 is detected by the sheet position sensor 17 (S204).

The amount of skew correction to be used for printing on the next paper sheet S is calculated by using the amount of displacement calculated from the conveyance position detected in step S204 and the correction coefficient $\alpha$ determined in step S203, and the calculated amount of skew correction is stored in the storage portion 12 or an internal memory of the image processing portion 13 (S205).

In the case where the amount of displacement (or the amount of swing) of the paper sheet S is dx and the sheet length is Ls, the amount (angle) of skew correction is calculated from the following formula (1).

$$\text{Amount of skew correction} = \alpha \times a \tan(dx/Ls) \quad (1)$$

What has been described above is the skew correction amount determination process S20. The amount of skew correction is used in image formation on the next paper sheet S.

Referring back to step S201, in printing on the second and subsequent paper sheets S, the amount of skew correction has been already determined in the previous printing (S201: YES). Therefore, in the next process, the skew corrector 132 determines the amount of skew correction in the skew correction amount determination process S20, and performs skew correction on image data by using the stored amount of skew correction (S202).

The skew corrector 132 performs the skew correction on the basis of the amount of skew correction as described above. For example, in the case where the amount of displacement at a leading end position is 2 mm and the correction coefficient $\alpha$ is 0.2, the amount of shift of the image data at the leading end position on the paper sheet S is 0.4 m (=2×0.2). A line image at the leading end position is shifted in the main scanning direction (width direction) by pixels of a number corresponding to 0.4 mm. The amount of shift of a line image at a center portion is a half of the amount of shift at the leading end position, and the amount of shift at a trailing end position is 0.

Then, image formation by the image forming part 14 is started by using the image data subjected to the skew correction process (S202). After this, the skew correction amount determination process S20 is performed again for the next printing.

Then, the registration swing is performed on the basis of the detected amount of displacement, and the conveyance position of the paper sheet S is adjusted (S206).

Then, image formation is performed, by the image forming part 14, on the paper sheet S that has been subjected to the registration swing and conveyed.

To be noted, although the amount of skew correction is updated each time printing is performed on a paper sheet S and the updated amount of skew correction is used for the next printing in the print job in the second embodiment, this is not limiting, and the amount of skew correction determined in a printing process for the first paper sheet S may be applied to printing on all the subsequent paper sheets S of the same print job including the second paper sheet S.

As described above, in the present embodiment, the skew can be reduced by performing a skew correction process by using an amount of skew correction in the case where registration swing in which the leading end side of a paper sheet is swung in the width direction by a registration roller pair is performed in a state in which the trailing end side of the paper sheet is nipped by a conveyance roller pair.

Third Embodiment

Figure 10:
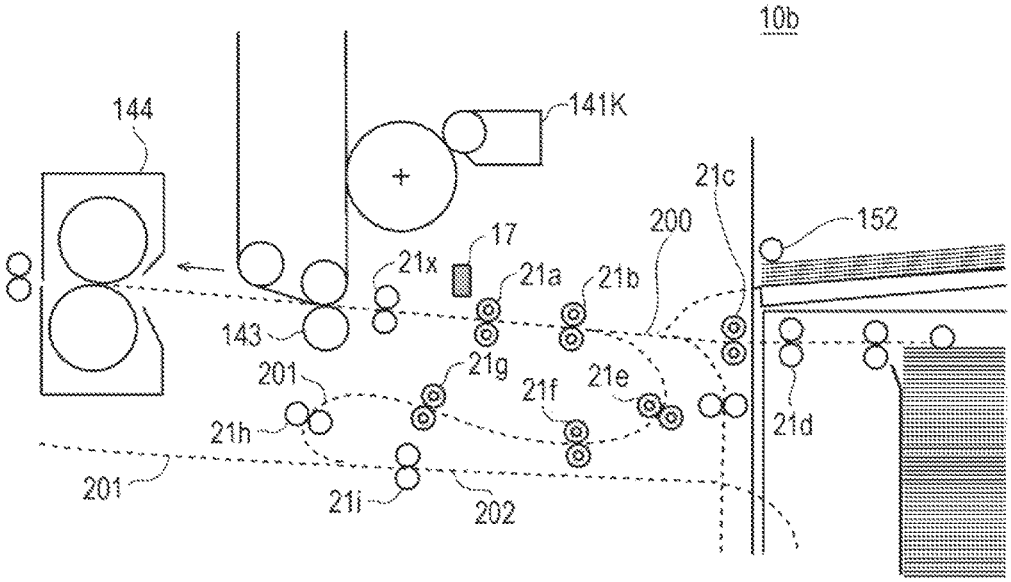
FIG. 10 is a partially enlarged view of an image forming apparatus according to an embodiment illustrating a schematic configuration thereof.
Figure 11:
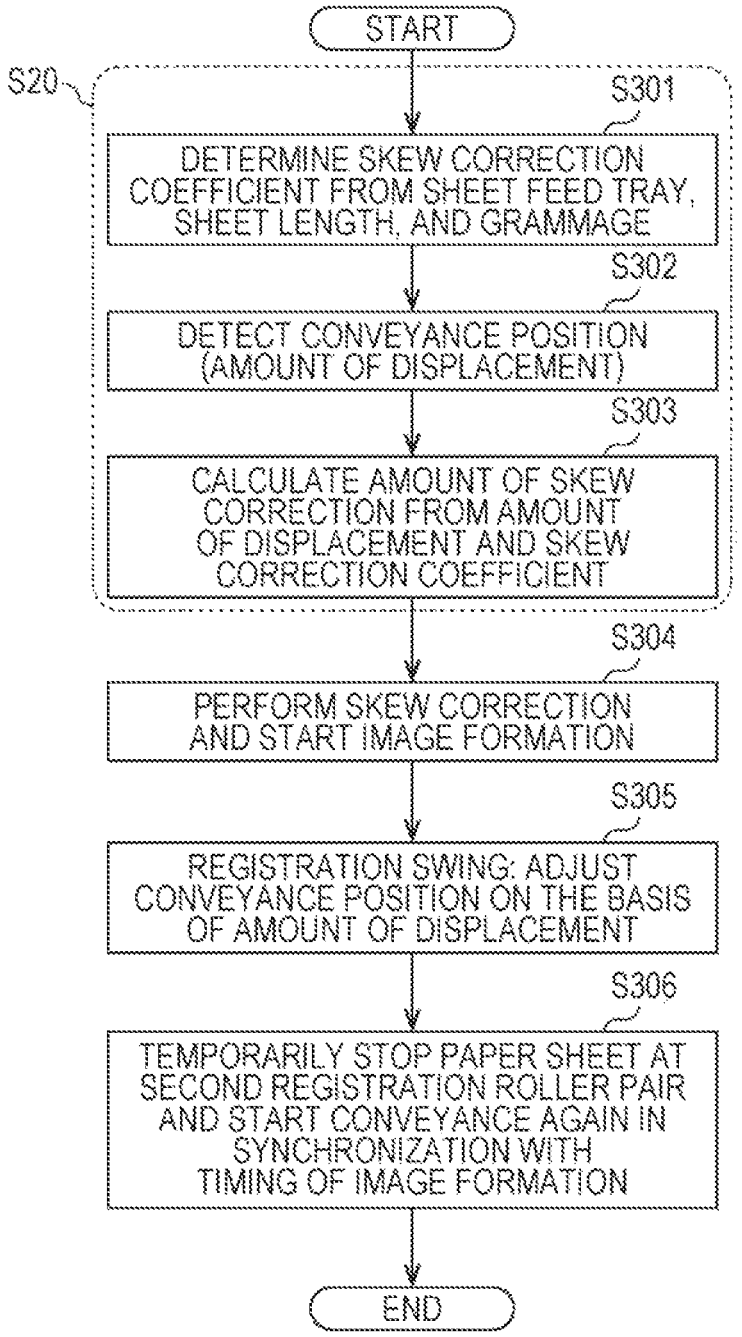
FIG. 11 is a flowchart illustrating a control method according to a third embodiment.

A method for controlling an image forming apparatus according to a third embodiment will be described with reference to FIGS. 10 and 11. FIG. 10 is a partially enlarged view of an image forming apparatus according to the third embodiment illustrating a schematic configuration thereof. FIG. 11 is a flowchart illustrating a control method according to the third embodiment.

An image forming apparatus 10*b* according to the third embodiment includes a second registration roller pair 21*x* in addition to the registration roller pair 21*a* (hereinafter also referred to as a "first registration roller pair 21*a*" particularly in the description of the present embodiment). The image forming apparatus 10*b* has the same configuration as the image forming apparatus 10 illustrated in FIGS. 1 to 3 except for the second registration roller pair 21*x*, so description of the other components than the second registration roller pair 21*x* will be omitted. The second registration roller pair 21*x* is disposed ten and several centimeters downstream of the first registration roller pair 21*a*. In the third embodiment, the registration swing of the paper sheet S is performed by the first registration roller pair 21*a*. The paper sheet S is caused to abut the second registration roller pair 21*x* that is stopped to temporarily stop the paper sheet S. and the rotation of the second registration roller pair 21*x* is started in a synchronization with the timing of image formation to start again the conveyance of the paper sheet S to the transfer position of the paper sheet S. The timing of swing of the first registration roller pair 21*a* is the same as the embodiments described above. That is, the swing is started immediately after detecting the amount of displacement, and movement to the swing target position is completed at least before the leading end of the paper sheet S reaches the transfer position. More preferably, the movement to the swing target position is completed before the conveyance of the paper sheet S is started again by the second registration roller pair 21*x*.

In the image forming apparatus 10 described above, it is required that the amount of skew correction used for image processing is determined before image formation on each page is started. Therefore, in the control method illustrated in FIG. 8, the amount of skew correction determined in the previous printing is applied to the next printing. In contrast, in the image forming apparatus 10*b* according to the third embodiment, the second registration roller pair 21*x* is provided, and thus more the for performing the image processing can be ensured. Thus, it becomes possible to detect the amount of displacement and determine the amount of skew correction before starting the image formation, that is, before starting exposure by the drawing portion. Hereinafter, description will be given with reference to FIG. 11.

In steps S301 to S303 serving as the skew correction amount determination process S20, the amount of skew correction is calculated and stored.

Subsequently, the skew corrector 132 performs skew correction on image data by using the amount of skew correction determined in the skew correction amount determination process S20, and the image forming part 14 starts image formation by using the image data that has been subjected to skew correction (S304). This process is the same as the process of step S202 described above except that the amount of skew correction determined from the amount of displacement of the paper sheet S in the current printing instead of the previous printing is used.

In the next process, the registration swing is performed on the basis of the detected amount of displacement, and the conveyance position of the paper sheet S is adjusted (S305).

Then, the paper sheet S is temporarily stopped at the second registration roller pair 21*x*, and the conveyance of the paper sheet S is started again in synchronization with an image formation timing of the image forming part 14 (S306). Then, image formation is performed on the paper sheet S whose conveyance has been started again, and the process is finished.

In the third embodiment, a similar effect to the second embodiment can be achieved, and, since the amount of skew correction is determined by using the amount of displacement of the paper sheet S that is actually conveyed, the precision of the skew correction becomes higher than the second embodiment.

Fourth Embodiment

In the second and third embodiments described above, the skew correction is performed by using the amount of skew correction determined in accordance with the amount of displacement. In a fourth embodiment, similarly to the first embodiment, a large skew is prevented from being caused by the registration swing, and, in the case where the amount of displacement or the amount of skew correction is equal to or larger than a predetermined threshold value, the adjustment of displacement is performed by image processing instead of the registration swing. This threshold value may be a predetermined fixed value, and may be updated by a user as appropriate. In addition, the threshold value may be determined on the basis of an upper limit of the amount of skew correction with which skew correction can be performed.

FIG. 12 is a flowchart illustrating a control method according to a fourth embodiment, and the flow is executed by the controller 11.

First, the controller 11 determines whether or not the amount of skew correction has been already determined in the previous printing in the same print job (corresponding to the same sheet feed tray) (S401). In the case where the first image of the print job is to be printed, the amount of skew correction is not determined (S401: NO), and thus image formation by the image forming part 14 is started by using image data with which skew correction is not to be performed (S404).

In the case where the amount of skew correction has been already determined (S401: YES), whether or not the amount of skew correction is equal to or larger than a predetermined threshold value (first threshold value) or the amount of displacement is equal to or larger than a predetermined threshold value (second threshold value) is determined (S402). In the case where either one of the conditions described above is satisfied (S402: YES), the registration swing is prohibited, and the process proceeds to the next process. In the next process, an image forming position of the image data is adjusted by the displacement adjuster 131 of the image processing portion 13 by using an amount of displacement S0 of the previous printing (S403). The reason why not the amount of displacement of the paper sheet S currently being conveyed but the amount of displacement S0 of the previous printing is used is because image processing cannot be finished before image formation of the current printing starts in the case where the amount of displacement of the paper sheet S currently being conveyed is used.

After this, processes of steps S404 to S407 that are processes similar to steps S207 and S203 to S205 of FIG. 8 are performed.

In contrast, in the case where neither of the two conditions is satisfied (S402: NO), skew correction is performed by using the amount of skew correction that has already been determined, and image formation is started.

After this, steps S412 to S414 serving as the skew correction amount determination process S20 is performed, and then the registration swing is performed by using the amount of displacement calculated in step S413 to adjust the conveyance position of the paper sheet S (S415). Then, image formation is performed, by the image forming part 14, on the paper sheet S that has been subjected to the registration swing and conveyed.

As described above, in the case where the amount of displacement or the amount of skew correction is equal to or larger than a predetermined threshold value, an effect similar to the first embodiment can be achieved by adjusting an image forming position by image processing by the displacement adjuster 131 without adjusting the conveyance position of the paper sheet S by the registration swing. That is, skew caused by the registration swing can be prevented. Moreover, by adjusting the image forming position by image processing, the displacement can be also prevented.

Instead of the determination based on the comparison between the amount of displacement and the amount of skew correction and the predetermined threshold values in step S402 of FIG. 12, whether or not a setting of always performing an "image displacement process" is made by a user may be determined. In the case where this setting is made, the processes of steps S403 to S407 are performed.

In addition although all of the amount of displacement is assigned not to adjustment by the registration swing portion 18 but to adjustment by the displacement adjuster 131 in the case where the condition of step S402 is satisfied in the fourth embodiment, embodiments of the present invention is not limited to this. For example, in the case where the amount of displacement exceeds a predetermined threshold value (for example, the second threshold value), adjustment of part of the displacement corresponding to the predetermined threshold value may be assigned to the adjustment of the position of the paper sheet S performed by the registration swing portion 18 and adjustment of the rest of the displacement may be assigned to the adjustment performed via image processing by the displacement adjuster 131. In this case, skew correction may be performed by the skew corrector 132 by using the amount of skew correction determined, on the basis of the amount of the part of the displacement whose adjustment is assigned to the registration swing portion 18, via a process similar to the skew correction amount determination process S20.

Fifth Embodiment

In the second and fourth embodiments, skew correction cannot be performed in the first printing in the print job because the amount of skew correction is not determined at the time of the first printing (S207). In a fifth embodiment, a "measurement mode" in which a blank paper sheet is conveyed before starting actual printing of the print job is executed in order to avoid such a situation, and the amount of skew correction is determined in advance in this measurement mode. This measurement mode may be executed by, for example, receiving an instruction from a user each time a print job is performed, or may be executed in the case where the measurement mode is set to be executed by the user via mode selection.

Figure 13:
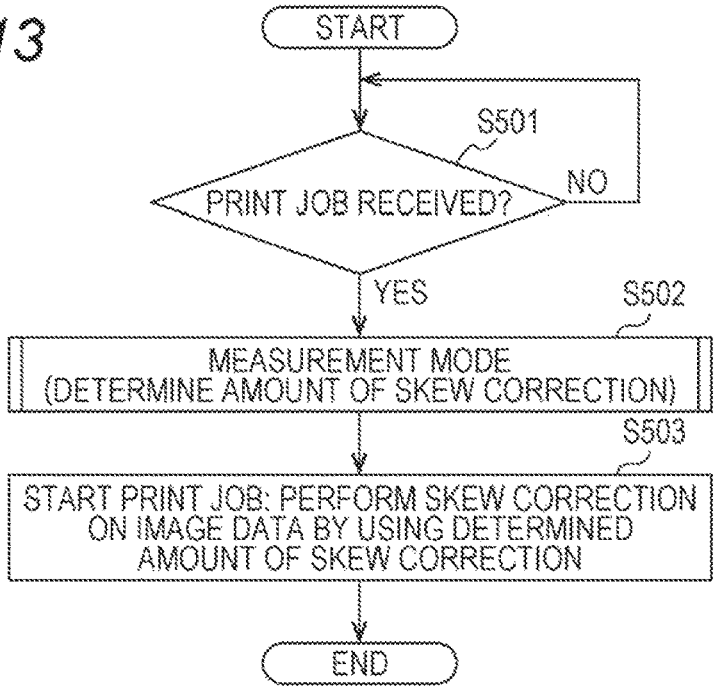
FIG. 13 is a flowchart illustrating a control method according to a fifth embodiment.
Figure 14A:
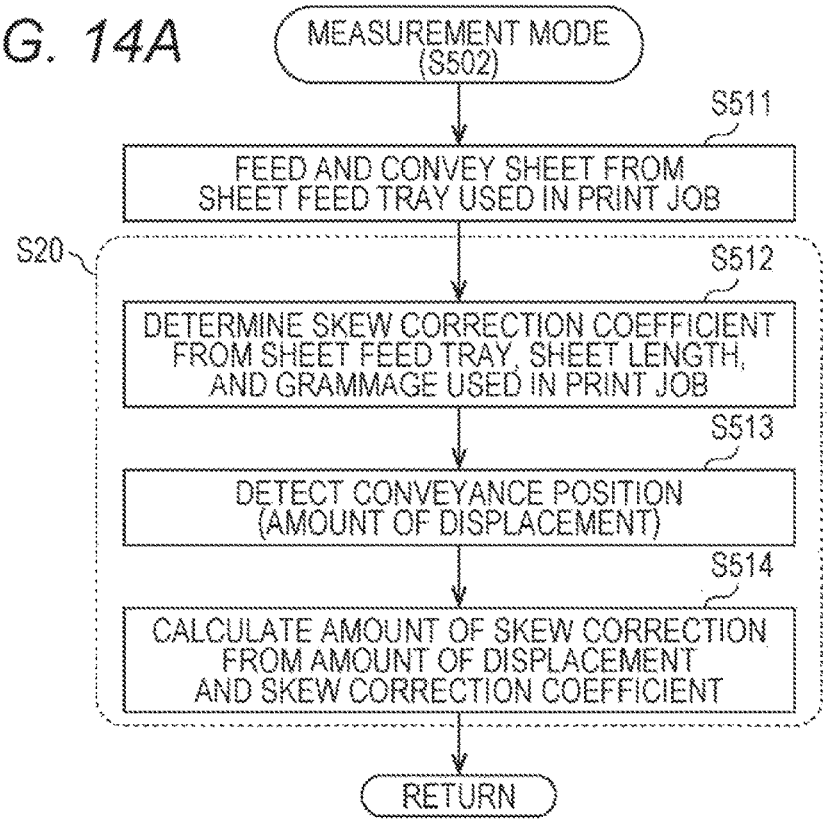
FIG. 14A is a diagram illustrating a sub-routine.

FIGS. 13 and 14A are each a flowchart illustrating a control method according to a fifth embodiment, and the flow is executed by the controller 11.

In FIG. 13, in the case where a print job is received (S501: YES), the measurement mode is executed next (S502).

FIG. 14A is a diagram illustrating a sub-routine of the measurement mode (S502). First, a skew correction coefficient is determined on the basis of the sheet feed tray, sheet length, and grammage of the paper sheet S to be used in the print job received in step S501 (S511). In the determination of the skew correction coefficient, a correction table such as a table illustrated in FIG. 9 is used.

Next, a paper sheet S is fed and conveyed from the sheet feed tray to be used in the print job (S512).

The conveyance position of the conveyed paper sheet S is detected by the sheet position sensor 17 (S513).

Next, the amount of skew correction to be used for printing on the next paper sheet S is calculated by using the amount of displacement calculated from the conveyance position detected in step S513 and the correction coefficient $\alpha$ determined in step S511, and the calculated amount of skew correction is stored in the storage portion 12 or the internal memory of the image processing portion 13 (S514). The paper sheet S (blank paper sheet) conveyed in this measurement mode is discharged onto the sheet discharge tray 22.

After this, the process returns to the processes of FIG. 13, and printing of the print job is performed on the first and subsequent paper sheets S on the basis of image data subjected to the skew correction process by using the amount of skew correction determined in step S502 (S503). The amount of skew correction determined in step S502 may be used in printing of the print job on the second and subsequent paper sheets S whose sheet feed tray and sheet length are the same, and skew correction for the next printing may be performed by using the amount of skew correction determined in the previous printing.

As described above, in the fifth embodiment, skew correction can be also performed on the first paper sheet S in the print job by executing the measurement mode.

Modification of Fifth Embodiment

In the third and fourth embodiments described above, the amount of skew correction is estimated by using the skew correction coefficient. In the present modification, in order to improve the precision of skew correction more, the amount of skew is obtained from an inclination of detected conveyance positions between the leading end and the trailing end of the paper sheet S that is actually conveyed. To be noted, in other embodiments, the amount of displacement used for determination of the amount of skew correction is basically calculated on the basis of the conveyance position of the paper sheet S before the paper sheet S is moved (swung) in the width direction by the registration swing.

Figure 14B:
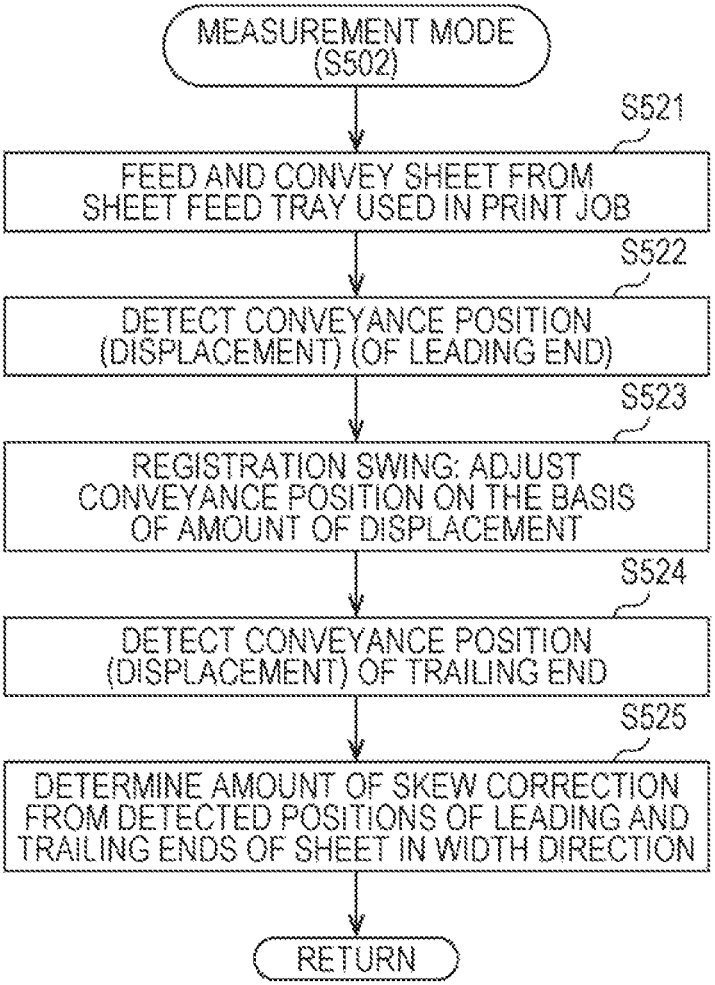
FIG. 14B is a diagram illustrating a sub-routine according to a modification.

FIG. 14B is a diagram illustrating a sub-routine according to a modification. First, a paper sheet S is fed and conveyed from the sheet feed tray to be used in the print job received in step S501 (S521).

The conveyance position of the leading end side of the conveyed paper sheet S is detected by the sheet position sensor 17 (S522).

Next, the registration swing is performed on the basis of the amount of displacement detected in step S522, and the conveyance position of the paper sheet S is adjusted (S523).

The conveyance position of the conveyed paper sheet S is continuously detected from the leading end to the trailing end by the sheet position sensor 17 (S524).

Then, the inclination of the paper sheet S is calculated from conveyance positions of the paper sheet S in the width direction detected at at least two positions of the leading end and the trailing end, and the calculated inclination is determined as the amount of skew correction (S525).

After this, the process returns to the process of FIG. 13, proceeds to the next step (S503), and the print job is started by using the amount of skew correction determined in step S525. It is preferable that the amount of skew correction determined in step S525 is continuously used for the print job on the second and subsequent paper sheets S whose sheet feed tray and sheet length are the same.

Sixth Embodiment

Figure 15:
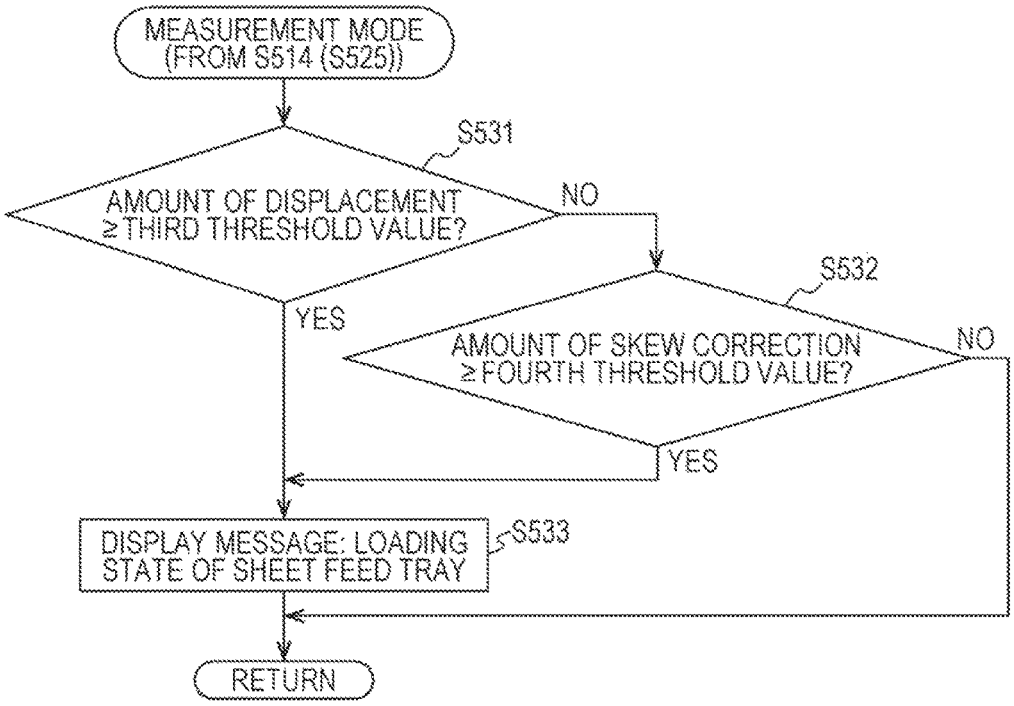
FIG. 15 is a flowchart illustrating a control method according to a sixth embodiment.

FIG. 15 is a flowchart illustrating a control method according to a sixth embodiment, and the flow is executed by the controller 11. The sixth embodiment corresponds to processes performed in the "measurement mode" (S502) described above.

After the amount of displacement and the amount of skew correction are determined in the measurement mode illustrated in FIG. 14A or 14B (S514 or S525), first, whether or not the amount of displacement is equal to or larger than a predetermined threshold value (third threshold value) is determined (S531).

In the case where the amount of displacement is not equal to or larger than the third threshold value (S531: NO), next, whether or not the amount of skew correction is equal to or larger than a predetermined threshold value (fourth threshold value) is determined (S532).

In the case where the amount of skew correction is not equal to or larger than the fourth threshold value (S532: NO), the process returns to the flowchart of FIG. 13, and the processes of step S404 and subsequent steps are performed.

Meanwhile, in the case where either one of the amount of displacement and the amount of skew correction is equal to or larger than the corresponding threshold value, a confirmation message for warning is displayed on a display screen 161 of the operation display portion 16 (S533).

Figures 16, 17:
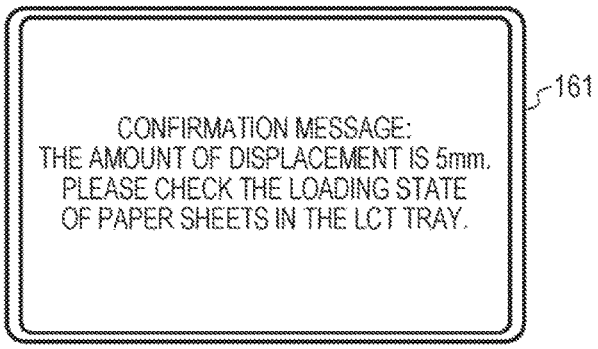
FIG. 16 illustrates an example of a confirmation message displayed on a display screen.
FIG. 17 is an example of a correction table used for determination of a skew correction coefficient in duplex printing.

FIG. 16 illustrates an example of the confirmation message displayed on the display screen 161. This confirmation message includes a message prompting confirmation of a loading state of a paper sheet S in the sheet feed tray or a result of detection of the amount of displacement. The confirmation message is displayed in the case where the amount of displacement is equal to or larger than the third threshold value, for example, 5 mm. This situation occurs in the case where the paper sheet S is not properly set particularly when, for example, a regulating plate that is disposed in the sheet feed tray 150 and regulates the position of the paper sheet S in the width direction has become loose. Therefore, in most cases, the amount of displacement and the amount of skew correction are decreased by a user reloading the paper sheet S in the sheet feed tray 150 and placing the paper sheet S in the sheet feed tray 150 in a proper state.

The sixth embodiment is not limited to the measurement mode, and may be alternatively applied to the first to fourth embodiments. Specifically, such a confirmation message as illustrated in FIG. 16 is displayed at the start of the print job or while performing the print job in the case where at least one of the amount of displacement and the amount of skew correction is equal to or larger than the predetermined threshold value. In addition, the same values as the second and first threshold values used in the fourth embodiment described above may be respectively used as the third and fourth threshold values, or different values may be used.

Other Modifications

The present invention is defined by the description of the claims, and various other modifications may be employed.

Other Modification 1

For example, as will be described below, the skew correction process performed in the second embodiment may be performed in a duplex mode in which images are formed on both surfaces of the paper sheet S.

FIG. 17 is an example of a correction table indicating a correspondence between each parameter of the sheet feed tray, the sheet length, and the grammage and the skew correction coefficient used in the duplex mode. This correction table is preset in correspondence with a paper sheet S to be conveyed through the conveyance paths 201 to 203 in the duplex mode. Specifically, the skew correction coefficient is defined on the basis of conditions including the sheet length and the number and position of at least one conveyance roller pair, among the conveyance roller pairs 21*a*, 21*b*, and 21*e* to 21*i* disposed along the conveyance path 203 extending from the sheet inverter to the adjustment position of the registration swing, that nips the paper sheet S in the case of performing the registration swing. Specifically, as illustrated in FIG. 3 and so forth, among the conveyance roller pairs 21*a* to 21*h* that come into contact with the paper sheet S at the time of the registration swing, the conveyance roller pair 21*h* does not take the separate state, and the other roller pairs 21*b* to 21*g* take the separate state. In addition, the conveyance roller pairs 21*f* and 21*h* are respectively disposed at positions upstream of and away from the adjustment position of the registration swing by 500 mm and 650 mm. To be noted, the upper limit of the sheet length included in the correction table is set to the maximum sheet length with which the paper sheet S can be inverted at the sheet inverter.

The skew correction coefficient is determined from the sheet length and grammage of the paper sheet S to be conveyed through the conveyance paths 201 to 203 by using the correction table, and skew correction is performed by obtaining the amount of skew correction by using this skew correction coefficient similarly to the second embodiment and so forth. In this way, an effect similar to the second embodiment can be achieved also in the duplex mode. Specifically, skew caused by the registration swing at the time of image formation on both surfaces can be reduced by performing the skew correction by using the calculated amount of skew correction.

Other Modification 2

The embodiments may be mutually combined. For example, the first embodiment may be combined with another embodiment. For example, the first embodiment may be combined with the second embodiment. Specifically the skew correction process of the second embodiment may be performed in the case where the registration swing is performed in the first embodiment illustrated in FIG. 6. Alternatively, the first embodiment may be combined with the fourth embodiment. For example, in the case where the registration swing is not performed in the first embodiment, the position of the image is adjusted by the displacement adjuster 131 as described in the fourth embodiment. In addition, the modification of the first embodiment may be combined with the second embodiment. That is, such a correction table as illustrated in FIG. 9 may be generated in advance by adding the conveyance speed of the paper sheet A as a new parameter, and the amount of skew correction is determined by using this correction table.

In addition, a program for operating the image forming apparatus 10 may be provided via a computer-readable recording medium such as a universal serial bus memory, a flexible disc, and a compact disc-ROM or may be provided online via a network such as the Internet. In this case, the program stored in the computer-readable recording medium is normally transmitted to and stored in a memory, a storage, or the like. In addition, this program may be provided as, for example, a single piece of application software, or may be built in software of each device as one function of the image forming apparatus 10.

Although embodiments of the present invention have been described and illustrated in detail, it is clearly understood that the same is by way of illustration and example only and not limitation, the scope of the present invention should be interpreted by terms of the appended claims.

What is claimed is:

1. An image forming apparatus comprising:

a plurality of sheet feed trays on which a plurality of sheets are placed;

a transferrer that transfers an image formed by an image forming part onto a sheet at a transfer position;

a plurality of conveyance roller pairs provided along conveyance paths from the plurality of sheet feed trays to the transfer position and that conveys a fed sheet;

a conveyance position detector that detects, at a position upstream of the transfer position, a conveyance position of a conveyed sheet in a width direction perpendicular to a conveyance direction;

a sheet position adjuster that performs, at an adjustment position upstream of the transfer position, adjustment of the conveyance position of the sheet in the width direction by using an amount of displacement calculated from the detected conveyance position; and a hardware processor that determines, on the basis of a sheet feed tray that is to be used among the plurality of sheet feed trays and a sheet length of a sheet that is to be fed from the sheet feed tray, whether or not the adjustment of the conveyance position is to be performed.

2. The image forming apparatus according to claim 1, wherein, in a case where whether or not the adjustment of the conveyance position of the sheet fed from the sheet feed tray to be used is to be performed is to be determined, the hardware processor determines whether or not the adjustment of the conveyance position is to be performed on the basis of the sheet length and a number and position of at least one conveyance roller pair that is included in the plurality of conveyance roller pairs, is disposed upstream of the adjustment position along the conveyance paths, and nips the sheet.

3. The image forming apparatus according to claim 1, wherein the hardware processor determines whether or not the adjustment of the conveyance position is to be performed further on the basis of at least one condition of a type, a grammage, and a conveyance speed of the conveyed sheet in addition to the sheet feed tray and the sheet length.

4. The image forming apparatus according to claim 1, further comprising a skew corrector, wherein, in a case where the adjustment of the conveyance position is determined to be performed, the hardware processor determines an amount of skew correction on the basis of the sheet length, the amount of displacement, and a number and position of at least one conveyance roller pair that is included in the plurality of conveyance roller pairs and nips the sheet in a case of performing the adjustment of the conveyance positions, and the skew corrector performs skew correction by adjusting an image forming position before transfer on the basis of the amount of skew correction determined by the hardware processor.

5. The image forming apparatus according to claim 4, wherein the hardware processor determines the amount of skew correction further on the basis of at least one condition of a type, a grammage, and a conveyance speed of the conveyed sheet.

6. An image forming apparatus comprising:

a plurality of sheet feed trays on which a plurality of sheets are placed;

a transferrer that transfers an image formed by an image forming part onto a sheet at a transfer position;

a plurality of conveyance roller pairs provided along conveyance paths from the plurality of sheet feed trays to the transfer position and that conveys a fed sheet;

a conveyance position detector that detects, at a position upstream of the transfer position, a conveyance position of a conveyed sheet in a width direction perpendicular to a conveyance direction;

a sheet position adjuster that performs, at an adjustment position upstream of the transfer position, adjustment of the conveyance position of the sheet in the width direction by using an amount of displacement calculated from the detected conveyance position;

a hardware processor that determines an amount of skew correction on the basis of a sheet feed tray that is to be used among the plurality of sheet feed trays, a sheet length of a sheet that is to be fed from the sheet feed tray, and the amount of displacement; and a skew corrector that performs skew correction by adjusting an image forming position before transfer on the basis of the amount of skew correction determined by the hardware processor.

7. The image forming apparatus according to claim 6, wherein the hardware processor determines the amount of skew correction on the basis of the sheet length, the amount of displacement, and a number and position of at least one conveyance roller pair that is included in the plurality of conveyance roller pairs, is disposed upstream of the adjustment position along the conveyance paths, and nips the sheet in a case where the adjustment of the conveyance position of the sheet fed from the sheet feed tray to be used is to be performed.

8. The image forming apparatus according to claim 6, wherein the hardware processor determines the amount of skew correction further on the basis of at least one condition of a type, a grammage, and a conveyance speed of the conveyed sheet.

9. The image forming apparatus according to claim 4, wherein the hardware processor uses the amount of skew correction determined on the basis of the amount of displacement of a previously conveyed sheet for skew correction of image data for a sheet to be conveyed next.

10. The image forming apparatus according to claim 4, wherein, in a case where the determined amount of skew correction is equal to or larger than a first threshold value or where the amount of displacement is equal to or larger than a second threshold value, the hardware processor prohibits the adjustment of the conveyance position or performs the adjustment of the conveyance position by using an amount of adjustment smaller than the amount of displacement.

11. The image forming apparatus according to claim 10, further comprising an image position adjuster that performs adjustment of an image position in the width direction by adjusting the image forming position before transfer, wherein, in a case where the determined amount of skew correction is equal to or larger than the first threshold value, where the amount of displacement is equal to or larger than the second threshold value, or where the adjustment of the image position is set to be performed, the hardware processor assigns all or part of the amount of displacement to the adjustment of the image position and determines the amount of skew correction in accordance with a remaining amount of displacement after the assignment.

12. The image forming apparatus according to claim 4, wherein the hardware processor executes a measurement mode in which a sheet is fed from one of the sheet feed trays and determines, on the basis of the amount of displacement, the amount of skew correction to be applied to skew correction of a print job in which the one of the sheet feed trays is used.

13. The image forming apparatus according to claim 4, further comprising a display, wherein, in a case where the amount of displacement is equal to or larger than a third threshold value or where the determined amount of skew correction is equal to or larger than a fourth threshold value, the display displays a message prompting confirmation of a loading state of a sheet in the sheet feed trays or a result of detection by the conveyance position detector.

14. The image forming apparatus according to claim 4, further comprising a sheet inverter that inverts front and back surfaces of a sheet on one surface of which an image has been formed by the image forming part and conveys the inverted sheet again to the image forming part, wherein the hardware processor determines the amount of skew correction on the basis of the sheet length of the inverted sheet, the amount of displacement, and a number and position of at least one conveyance roller pair that is included in the plurality of conveyance roller pairs, is disposed upstream of the adjustment position along a conveyance path from the sheet inverter to the adjustment position, and nips the sheet in a case where the adjustment of the conveyance position of the conveyed sheet is to be performed.

15. The image forming apparatus according to claim 1, wherein a compression canceller is provided for at least one of the plurality of conveyance roller pairs that is disposed upstream of the adjustment position along the conveyance paths, and the compression canceller is capable of switching the at least one of the plurality of conveyance roller pairs to a canceled state in which the at least one of the plurality of conveyance roller pairs does not nip the sheet.

16. A method for controlling the image forming apparatus according to claim 1, the method comprising:

determining, on the basis of a sheet feed tray that is to be used among the plurality of sheet feed trays and a sheet length of a sheet that is to be fed from the sheet feed tray, whether or not the adjustment of the conveyance position is to be performed.

17. A method for controlling the image forming apparatus according to claim 6, the method comprising:

determining the amount of skew correction on the basis of a sheet feed tray that is to be used among the plurality of sheet feed trays, a sheet length of a sheet that is to be fed from the sheet feed tray, and the amount of displacement.

18. The image forming apparatus according to claim 6, wherein a compression canceller is provided for at least one of the plurality of conveyance roller pairs that is disposed upstream of the adjustment position along the conveyance paths, and the compression canceller is capable of switching the at least one of the plurality of conveyance roller pairs to a canceled state in which the at least one of the plurality of conveyance roller pairs does not nip the sheet.

* * * * *